US011206917B2

(12) United States Patent
Hohlbein et al.

(10) Patent No.: US 11,206,917 B2
(45) **Date of Patent: *Dec. 28, 2021**

(54) ORAL CARE IMPLEMENT AND METHOD OF FORMING THE SAME

(71) Applicant: Colgate-Palmolive Company, New York, NY (US)

(72) Inventors: Douglas Hohlbein, Hopewell, NJ (US); Kenneth Waguespack, North Brunswick, NJ (US); Daniel Wainless, New Brunswick, NJ (US)

(73) Assignee: Colgate-Palmolive Company, New York, NY (US)

( * ) Notice: Subject to any disclaimer, the term of this patent is extended or adjusted under 35 U.S.C. 154(b) by 60 days.

This patent is subject to a terminal disclaimer.

(21) Appl. No.: 16/864,242

(22) Filed: May 1, 2020

(65) Prior Publication Data

US 2020/0253367 A1 Aug. 13, 2020

Related U.S. Application Data

(62) Division of application No. 15/933,425, filed on Mar. 23, 2018, now Pat. No. 10,674,808.

(51) Int. Cl.

| | |
|---|---|
| ***A46B 9/04*** | (2006.01) |
| ***A46B 3/04*** | (2006.01) |
| ***A46D 1/00*** | (2006.01) |

(52) U.S. Cl.

CPC ..... *A46B 9/04* (2013.01); *A46B 3/04* (2013.01); *A46D 1/0292* (2013.01); *A46B 2200/1066* (2013.01)

(58) Field of Classification Search

CPC ..... A46B 9/04; A46B 3/04; A46B 2200/1066; A46D 1/0292

See application file for complete search history.

(56) References Cited

U.S. PATENT DOCUMENTS

| | | | |
|---|---|---|---|
| 1,924,152 | A | 8/1933 | Coney et al. |
| 3,230,562 | A | 1/1966 | Birch |

(Continued)

FOREIGN PATENT DOCUMENTS

| | | |
|---|---|---|
| CN | 1218374 | 6/1999 |
| CN | 101472503 | 7/2009 |

(Continued)

OTHER PUBLICATIONS

International Search Report and Written Opinion of the International Searching Authority in International Application No. PCT/US2019/023059, dated May 22, 2019.

*Primary Examiner* — Weilun Lo

(57) ABSTRACT

An oral implement and a method of forming an oral care implement. The oral care implement may include a head having a front surface and a plurality of tooth cleaning elements extending from the front surface. In one embodiment, the plurality of tooth cleaning elements may include three different types of tooth cleaning elements, each type of tooth cleaning element being formed of a different material. In one embodiment each of the materials has a different hardness and thus the oral care implement includes three different types of tooth cleaning elements each having a different hardness. In another embodiment, the oral care implement may include bristles and a molded cleaning element that may function as an interdental cleaner. Such a molded cleaning element may include a body and tines extending therefrom.

15 Claims, 20 Drawing Sheets

(56) References Cited

U.S. PATENT DOCUMENTS

| | | | | |
|---|---|---|---|---|
| 3,295,156 | A * | 1/1967 | Josephh | A46B 9/04 15/167.1 |
| 3,325,845 | A * | 6/1967 | Sawkiw | A46D 1/0292 15/207.2 |
| 3,553,759 | A | 1/1971 | Kramer et al. | |
| 4,268,933 | A | 5/1981 | Papas | |
| 5,459,899 | A | 10/1995 | Bauer | |
| 5,682,911 | A | 11/1997 | Harada | |
| 6,475,553 | B2 | 11/2002 | Guay et al. | |
| 6,506,327 | B2 | 1/2003 | Weihrauch | |
| 6,599,048 | B2 | 7/2003 | Kuo | |
| 6,767,209 | B1 | 7/2004 | Tomita et al. | |
| 6,792,642 | B2 | 9/2004 | Wagstaff | |
| 6,826,797 | B1 | 12/2004 | Chenvainu et al. | |
| 6,895,629 | B1 | 5/2005 | Wenzler | |
| 6,993,804 | B1 | 2/2006 | Braun et al. | |
| 7,480,955 | B2 | 1/2009 | Hohlbein et al. | |
| 7,503,093 | B2 | 3/2009 | Weihrauch | |
| 7,644,466 | B2 | 1/2010 | Weihrauch et al. | |
| 8,141,563 | B2 | 3/2012 | De Masi, Sr. | |
| 8,408,833 | B2 | 4/2013 | Bartschi et al. | |
| 8,444,416 | B2 | 5/2013 | Chenvainu et al. | |
| 8,584,301 | B2 | 11/2013 | Maissami | |
| 8,677,541 | B2 | 3/2014 | Meadows et al. | |
| 8,695,611 | B2 | 4/2014 | Snedden et al. | |
| 8,776,302 | B2 | 7/2014 | Baertschi et al. | |
| 9,066,579 | B2 * | 6/2015 | Hess | A46D 3/04 |
| 9,210,995 | B2 | 12/2015 | Su et al. | |
| 9,402,700 | B2 | 8/2016 | Patel et al. | |
| 9,538,836 | B2 | 1/2017 | Mintel et al. | |
| 9,635,928 | B2 | 5/2017 | Morgott | |
| 9,700,127 | B2 | 7/2017 | Wagstaff | |
| 9,750,334 | B2 | 9/2017 | Kirchhofer et al. | |
| 10,136,723 | B2 | 11/2018 | Moskovich | |
| 10,278,485 | B2 | 5/2019 | Hohlbein et al. | |
| 2002/0059685 | A1 | 5/2002 | Paffrath | |
| 2006/0048323 | A1 | 3/2006 | Rueb | |
| 2006/0179593 | A1 | 8/2006 | Okamura | |
| 2008/0301893 | A1 | 12/2008 | Erskine-Smith | |
| 2015/0135456 | A1 | 5/2015 | Kirchhofer et al. | |
| 2016/0270519 | A1 | 9/2016 | Lee et al. | |
| 2017/0164724 | A1 | 6/2017 | Moskovich | |
| 2017/0290412 | A1 | 10/2017 | Pires et al. | |
| 2018/0168783 | A1 | 6/2018 | Kato et al. | |

FOREIGN PATENT DOCUMENTS

| | | |
|---|---|---|
| EP | 2144529 | 1/2010 |
| EP | 2974619 | 1/2016 |
| WO | 2002/011583 | 2/2002 |
| WO | 2007/032955 | 3/2007 |
| WO | 2011/093874 | 8/2011 |
| WO | 2017/076839 | 5/2017 |
| WO | 2017/106065 | 6/2017 |

* cited by examiner

ORAL CARE IMPLEMENT AND METHOD OF FORMING THE SAME

CROSS-REFERENCE TO RELATED APPLICATIONS

The present application is a divisional of U.S. patent application Ser. No. 15/933,425, filed Mar. 23, 2018, the entirety of which is incorporated herein by reference.

BACKGROUND

Myriad implements and devices for maintaining oral health are known. For example, toothbrushes of both the manual and powered variety, floss, dentifrices, applicators, agents, and the like are all known to provide different benefits in the oral cavity. Typically, a toothbrush includes extruded monofilaments that are grouped together into tufts. The tips of these grouped monofilaments produce a cleansing effect as they are dragged across the tooth surface, dislodging soft dental plaque along the way. Furthermore, toothbrushes have been developed that include elastomeric or rubber lamella to perform a wiping or polishing function during toothbrushing. However, a great deal of plaque and other bacteria often stays trapped in the interdental spaces and this plaque and bacteria is not adequately removed using conventional type toothbrushes. Although flossing is a technique that is advocated by dental professionals for removing this type of plaque and bacteria, people do not floss with the same frequency that they brush their teeth. Thus, a need exists for a toothbrush that can perform a traditional cleaning function while also improving interdental cleaning. Furthermore, a need exists for a toothbrush having cleaning elements formed from different materials to enhance the cleaning effect of the toothbrush.

BRIEF SUMMARY

The present invention is directed to an oral care implement and a method of forming an oral care implement. The oral care implement may include a head having a front surface and a plurality of tooth cleaning elements extending from the front surface. In one embodiment, the plurality of tooth cleaning elements may include three different types of tooth cleaning elements, each type of tooth cleaning element being formed of a different material. In another embodiment, the oral care implement may include bristles and an interdental cleaning element. Such an interdental cleaning element may include a body and tines extending therefrom.

In one aspect, the invention may be an oral care implement comprising: a head comprising a front surface; a plurality of tooth cleaning elements extending from the front surface of the head, the plurality of tooth cleaning elements comprising: a first tooth cleaning element formed of a first material; a second tooth cleaning element formed of a second material; and a third tooth cleaning element formed of a third material; and wherein the first, second, and third materials are different from one another.

In another aspect, the invention may be an oral care implement comprising: a head comprising a front surface; at least one bristle extending from the front surface of the head; and at least one molded cleaning element extending from the front surface of the head, the molded cleaning element comprising a body extending from a proximal end to a distal end along a longitudinal axis and a plurality of tines extending from the body at an oblique angle, wherein each of the tines extends from the body at a location between the proximal and distal ends of the body.

In yet another embodiment, the invention may be a method of forming an oral care implement, the method comprising: forming a body comprising a head and a handle, the head comprising a front surface having a plurality of holes; injecting a material into a mold cavity to form a molded cleaning element in the mold cavity, the molded cleaning element comprising a body extending from a first end to a second end along a longitudinal axis, the body having a first portion, a second portion, and a third portion, a first plurality of tines extending from the first portion of the body and a second plurality of tines extending from the second portion of the body, the third portion of the body being located between the first and second portions of the body and being free of any tines extending therefrom; removing the molded cleaning element from the mold cavity; folding the molded cleaning element along the third portion of the body so that the first and second portions of the body become axially aligned; inserting a portion of the molded cleaning element into one of the holes in the front surface of the head; and coupling the molded cleaning element to the head with a connection member so that the molded cleaning element extends from the front surface of the head.

In still another aspect, the invention may be a method of forming an oral care implement, the method comprising: a) forming a head comprising a front surface having a plurality of holes; and b) injecting a material into at least one of the plurality of holes to form a molded cleaning element that extends from the front surface of the head, the molded cleaning element comprising a body extending from a proximal end to a distal end along a longitudinal axis, the body having a lower axial section and an upper axial section, a plurality of tines extending from the upper axial section of the body and the lower axial section of the body being free of any tines extending therefrom.

In another aspect, the invention may be a molded tooth cleaning element comprising: a body extending from a first end to a second end along a longitudinal axis, the body comprising a first portion that includes the first end, a second portion that includes the second end, and a third portion located between the first and second portions; a first plurality of tines extending from the body at an oblique angle along the first portion of the body, the first plurality of tines extending towards the first end of the body; a second plurality of tines extending from the body at an oblique angle along the second portion of the body, the second plurality of tines extending towards the second end of the body; and wherein the body is alterable between: (1) an unfolded state in which the first and second portions of the body are axially spaced apart from one another; and (2) a folded state in which the first and second portions of the body are axially aligned with one another.

In yet another aspect, the invention may be a molded tooth cleaning element comprising: a body extending from a proximal end to a distal end along a longitudinal axis; a plurality of tines extending from the body at an oblique angle towards the distal end of the body, wherein each of the tines extends from the body at a location between the proximal and distal ends of the body; wherein the body and the plurality of tines are integrally formed via injection molding.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
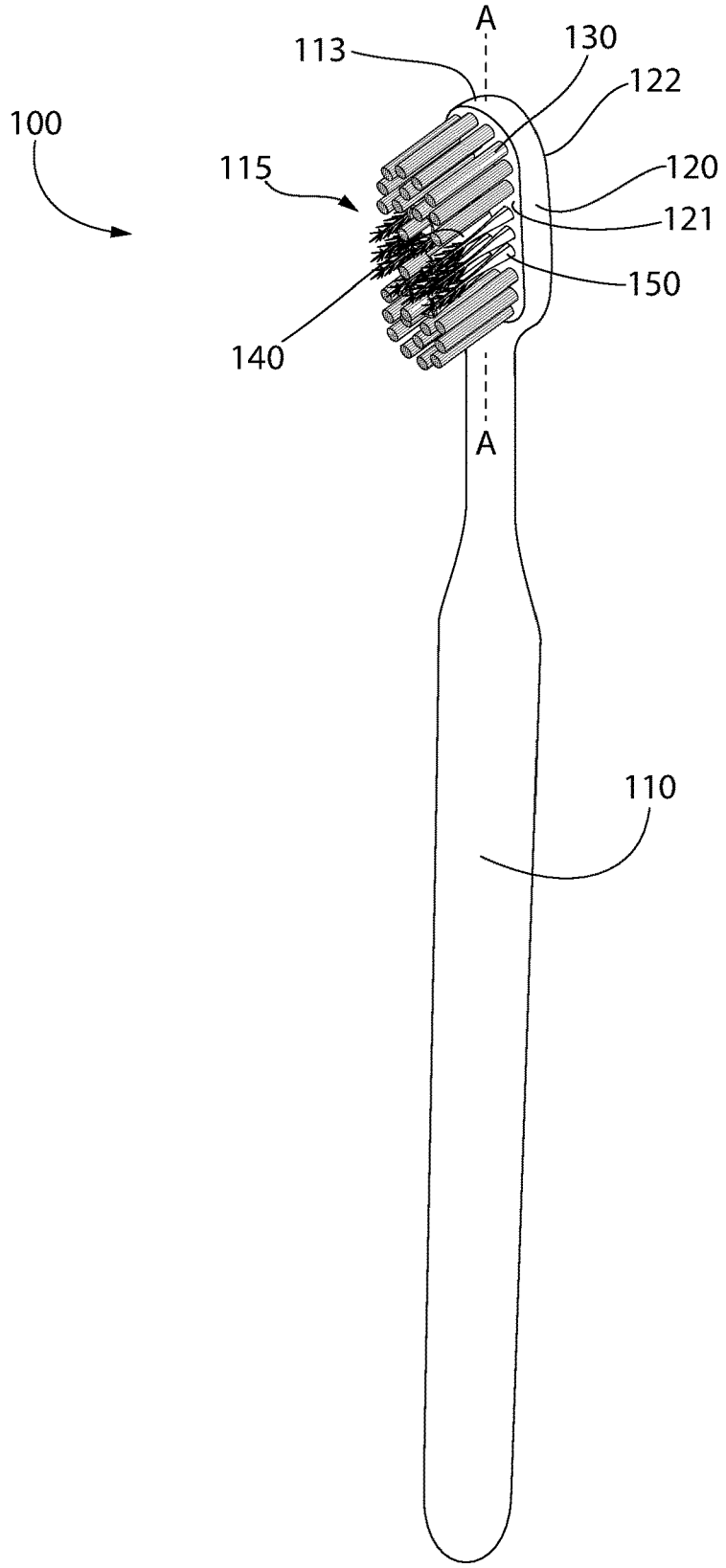
FIG. 1 is a perspective view of an oral care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 2:
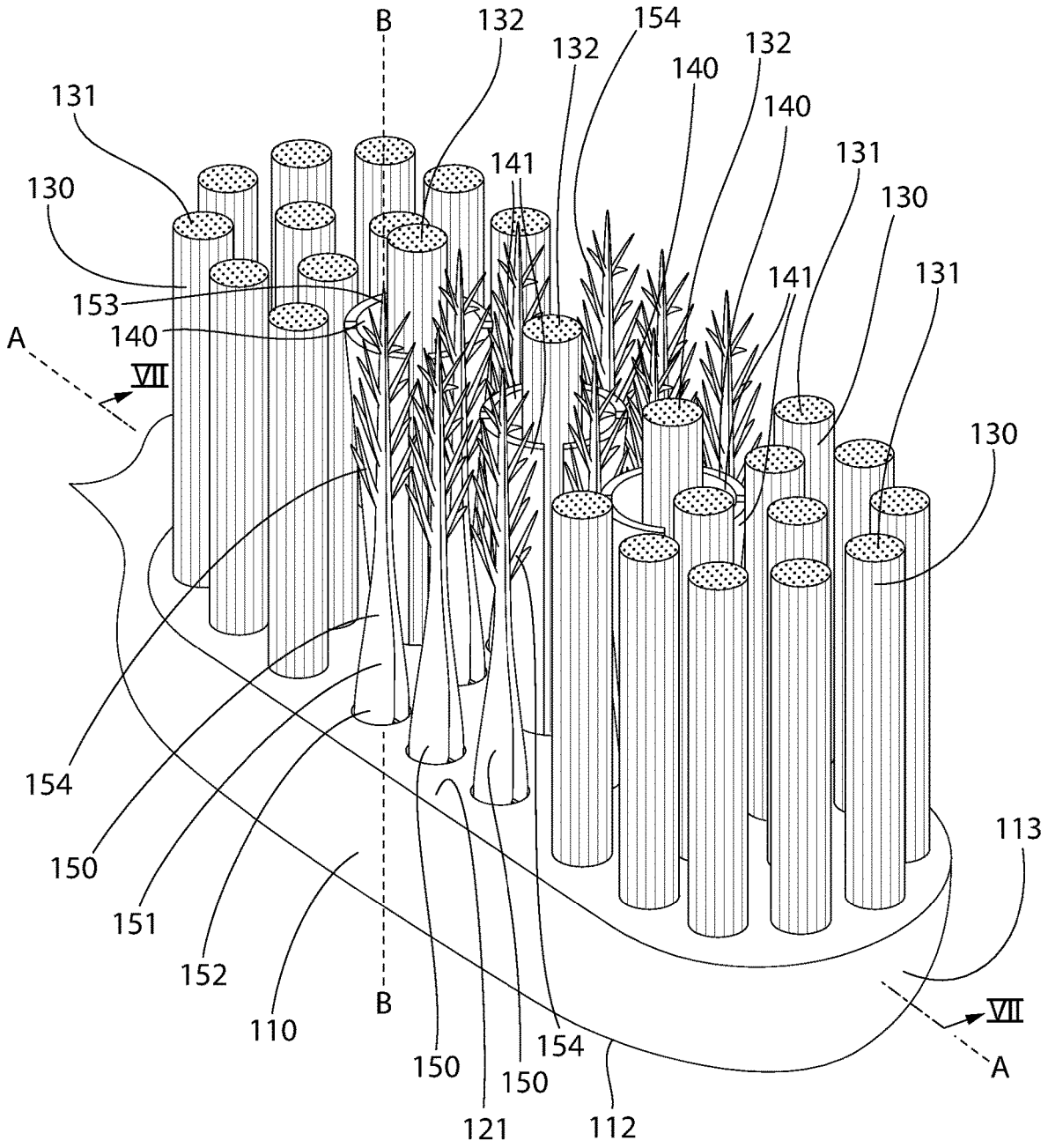
FIG. 2 is a close-up view of a head of the oral care implement of FIG. 1.

Referring to FIGS. 1 and 2, an oral care implement 100 is illustrated in accordance with an embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims. However, in a preferred embodiment the oral care implement is a manual or powered toothbrush.

The oral care implement 100 generally comprises a handle 110 and a head 120. The handle 110 is an elongated structure that provides the mechanism by which the user can hold and manipulate the oral care implement 100 during use. In the exemplified embodiment, the handle 110 is generically depicted having various contours for user comfort. The specific shape provided for the handle 110 in the drawings is not to be limiting of the invention. Thus, in certain other embodiments the handle 110 can take on a wide variety of shapes, contours and configurations, none of which are limiting of the present invention unless so specified in the claims.

In the exemplified embodiment, the handle 110 is formed of a rigid plastic material, such as for example without limitation polymers and copolymers of ethylene, propylene, butadiene, vinyl compounds and polyesters such as polyethylene terephthalate. In some embodiments, the handle 110 may include a resilient material, such as a thermoplastic elastomer, as a grip cover that is molded over portions of or the entirety of the handle 110 to enhance the gripability of the handle 110 during use. For example, portions of the handle 110 that are typically gripped by a user's palm and thumb/forefinger during use may be overmolded with a thermoplastic elastomer or other resilient material to further increase comfort to a user.

The head 120 of the oral care implement 100 is coupled to the handle 110 and comprises a front surface 121 and an opposing rear surface 122. The head 120 extends from the handle 110 to a distal end 113 along a longitudinal axis A-A. In the exemplified embodiment, the head 120 is formed integrally with the handle 110 as a single unitary structure using a molding, milling, machining or other suitable process. Thus, in the exemplified embodiment the head 120 is formed of the same material as the handle 110, such materials having been listed above. However, in other embodiments the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In such embodiments, the head 120 may be formed of the same material as the handle 100 or a different material.

In the exemplified embodiment, the head 120 of the oral care implement 100 is provided with a plurality of tooth cleaning elements 115 extending from the front surface 121. The tooth cleaning elements 115 may include at least one first tooth cleaning element 130, at least one second tooth cleaning element 140, and at least one third tooth cleaning element 150. In the exemplified embodiment, the plurality of tooth cleaning elements 115 include a plurality of each of the first, second, and third tooth cleaning elements 130, 140, 150. In certain embodiments, the first tooth cleaning element 130 may be formed of a first material, the second tooth cleaning element 140 may be formed of a second material, and the third tooth cleaning element 150 may be formed of a third material, the first, second, and third materials being different from one another. In some embodiments the first material has a first hardness, the second material has a second hardness, and the third material has a third hardness, the first, second, and third hardnesses being different from one another. In some embodiments, the first hardness may be greater than the third hardness and the third hardness may be greater than the second hardness. Some properties of the first, second, and third materials in accordance with a non-limiting embodiment of the present invention are provided below in Table 1. In some embodiments each of the first, second, and third tooth cleaning elements 130, 140, 150 may have a different shape.

TABLE 1

| Properties (ASTM) | Method | Value: First Material A | First Material B | Second Material | Third Material | Unit |
|---|---|---|---|---|---|---|
| Physical | | | | | | |
| Specific Gravity | ASTM D792 | 1.14 | 1.31 | 0.9 | 1.18 | |
| Mechanical | | | | | | |
| Flexural Modulus | ASTM D790 | 2830 | 2758 | | | MPa |
| Tensile Strength at Yield | ASTM D638 | 83 | 59 | | | MPa |
| Tensile Elongation at Yield | ASTM D638 | 5 | 10+ | | | % |
| Tensile Strength | ASTM D412 | | | 570 | 5500 | psi |
| Ultimate Elongation | ASTM D412 | | | 820 | 680 | % |
| Tensile stress at 100% elongation | ASTM D412 | | | 70 | 400 | psi |
| Tensile stress at 300% elongation | ASTM D412 | | | 150 | 600 | psi |
| Hardness | | | | | | |
| Shore | ASTM D2240 | | | 25 | 75 | A |
| Rockwell | ASTM D785 | 121 | 117 | | | R |

In some embodiments, the first material may have a Rockwell hardness in the range of 110-130, and more specifically 115-125. In some embodiments the second material may have a Shore A hardness in a range of 15-35, more specifically 20-30. In some embodiments the third material may have a Shore A hardness in a range of 65-85, and more specifically 70-80. These ranges are merely exemplary and hardness values outside of these ranges are possible in other embodiments.

In the exemplified embodiment, the first tooth cleaning element 130 is a bristle, the second tooth cleaning element 140 is a lamella, and the third tooth cleaning element 150 is a molded cleaning element, which in some embodiments may be referred to as an interdental cleaning element. However, the invention is not to be so limited in all embodiments. Specifically, in the exemplified embodiment the third tooth cleaning element 150 has a specific shape and structure intended to perform an interdental cleaning, the details of such shape and structure being described below. However, in other embodiments the third tooth cleaning element 150 may simply be a molded bristle having a cylindrical or conical shape. Thus, although the third tooth cleaning element 150 is illustrated having a specific structure intended for enhanced interdental cleaning, in other embodiments the third tooth cleaning element 150 may have a similar shape and/or structure to the first tooth cleaning element 130, but simply be formed of a different material as described herein. The details of the first, second, and third tooth cleaning elements 130, 140, 150 in accordance with exemplary embodiments of the invention are provided below.

The first tooth cleaning elements 130 may comprise bristles that are grouped into bristle tufts 131. The first tooth cleaning elements 130 may be formed of a first material, which may be nylon or polybutylene terephthalate. A bristle tuft is a collection of bristles that are positioned together into a single tuft hole formed on the head 120. The exact structure, pattern, orientation and material of the first tooth cleaning elements 130 is not to be limiting of the present invention unless so specified in the claims. Common examples of tooth cleaning elements that may be used as the first tooth cleaning elements 130 include, without limitation, bristle tufts, filament bristles, fiber bristles, nylon bristles, spiral bristles, combinations thereof and/or structures containing such materials or combinations.

As noted above, the second tooth cleaning elements 140 are what is generally referred to in the art as a lamella. Thus, in the exemplified embodiment the second tooth cleaning elements 140 are wall-like protrusions extending from the front surface 121 of the head 120. The second tooth cleaning elements 140 are formed of a second material that is different than the first material from which the first tooth cleaning elements 130 are formed. In one embodiment, the second tooth cleaning elements 140 may be formed of a thermoplastic elastomer excluding thermoplastic polyurethane. Thus, while the second tooth cleaning elements are preferably formed of a thermoplastic elastomer, they are not formed from thermoplastic polyurethane. The second tooth cleaning elements 140 may be rubber bristles, elastomeric protrusions, flexible polymer protrusions, combinations thereof and/or structures containing such materials or combinations.

In the exemplified embodiment, the second tooth cleaning elements 140 comprise a plurality of arcuate-shaped segments 141 that are positioned in a circular arrangement about an axis. This allows the second tooth cleaning elements 140 to have a significant amount of flexibility during use of the toothbrush 100 so that the second tooth cleaning elements 140 can wipe and polish the teeth. In the exemplified embodiment, there are three circular arrangements of the second tooth cleaning elements 140 positioned in a spaced apart manner along the longitudinal axis A-A of the head 120. However, there may be only one circular arrangement of the second tooth cleaning elements 140 or a plurality of them positioned in other locations along the head 120 as may be desired.

In the exemplified embodiment, there is a single bristle tuft 132 located within each circular arrangement of the second tooth cleaning elements 140. Specifically, a single bristle tuft 132 is located within the circular arrangement of the second tooth cleaning elements 140 so that the single bristle tuft 132 is surrounded by the second tooth cleaning elements 140. Of course, the invention is not to be so limited in all embodiments and in alternative embodiments the single bristle tufts 132 may be omitted.

The invention is not to be limited by the shape of the second tooth cleaning elements 140 in all embodiments and different shapes may be used for the second tooth cleaning elements 140. In alternative embodiments, the second tooth cleaning elements 140 may take on any desired shape, such as being a unitary cup-shaped member, linear wall-like segments, elongated protrusions, an element having different polygonal or irregular shapes, or the like. Thus, the invention is not to be particularly limited by the shape of the second tooth cleaning elements 140 in all embodiments. Moreover, in some embodiments the second tooth cleaning elements 140 may include tooth cleaning elements having more than one shape, such as including arcuate segments, elongated protrusions, and cup-shaped members. In such embodiments, the second tooth cleaning elements 140 may be all of the tooth cleaning elements that are formed of the second material, regardless of their shape or location on the head 120.

As noted above, the second tooth cleaning elements 140 are formed of a second material that may be an elastomeric material. Suitable elastomeric materials for the second material that forms the second tooth cleaning elements 140 include any biocompatible resilient material suitable for uses in an oral hygiene apparatus. To provide optimum comfort as well as cleaning benefits, the elastomeric material of the second tooth cleaning elements 140 may have a hardness property in the range of A8 to A25 Shore hardness. One suitable elastomeric material that can be used as the second material is styrene-ethylene/butylene-styrene block copolymer (SEBS) manufactured by GLS Corporation. Nevertheless, SEBS material from other manufacturers or other materials within and outside the noted hardness range could be used.

In the exemplified embodiment, the third tooth cleaning elements 150 are interdental cleaning elements formed of a third material that is a different material than each of the first and second materials. However, as noted above the third tooth cleaning elements 150 need not have the structure of an interdental cleaning element in all embodiments. Rather, in some embodiments the third tooth cleaning elements 150 may take on any shape, including the shapes denoted above for the second tooth cleaning elements 140, while being formed of a different material than the second tooth cleaning elements 140. In fact, in one embodiment all of the tooth cleaning elements 130, 140, 150 may have a similar shape, but be formed of a different material having a different hardness value. For example, all of the tooth cleaning elements 130, 140, 150 may be cylindrical, conical, or the like while having different material properties to provide different cleaning benefits to a user. In another embodiment, such as the exemplified embodiment, the tooth cleaning elements 130, 140, 150 may each have a different shape and be formed from a different material having different hardness values.

In one specific embodiment, the third material that forms the third tooth cleaning elements 150 may be thermoplastic polyurethane. In another embodiment, the third material may be a softer grade of nylon than the nylon of the first material. In the specific embodiment illustrated in the drawings, the third tooth cleaning elements 150 comprise a body 151 extending from a proximal end 152 to a distal end 153 along a longitudinal axis B-B and a plurality of tines 154 extending from the body 151. Additional details about the third tooth cleaning elements 150 will be provided below with reference to FIGS. 4 and 5.

The tooth cleaning elements 115 of the present invention can be connected to the head 120 in any manner known in the art. For example, staples/anchors, in-mold tufting (IMT) or anchor free tufting (AFT) could be used to mount the cleaning elements/tooth engaging elements. In some embodiments the first and second tooth cleaning elements 130, 140 may be connected to the head 120 using staples/anchors while the third tooth cleaning elements 150 are injection molded to the head 120. In other embodiments the first tooth cleaning elements 130 may be coupled to the head 120 using AFT or IMT and the second and third tooth cleaning elements 140, 150 may be coupled to the head via injection molding. Thus, the different types of tooth cleaning elements 130, 140, 150 may be coupled to the head 120 in different ways. Stated another way, in certain embodiments the invention can be practiced with various combinations of stapled, IMT or AFT tooth cleaning elements. As discussed more fully below, in AFT a plate or membrane is secured to the brush head such as by ultrasonic welding. The tooth cleaning elements extend through the plate or membrane. The free ends of the tooth cleaning elements on one side of the plate or membrane perform the cleaning function. The ends of the tooth cleaning elements on the other side of the plate or membrane are melted together by heat to be anchored in place.

Figure 3A:
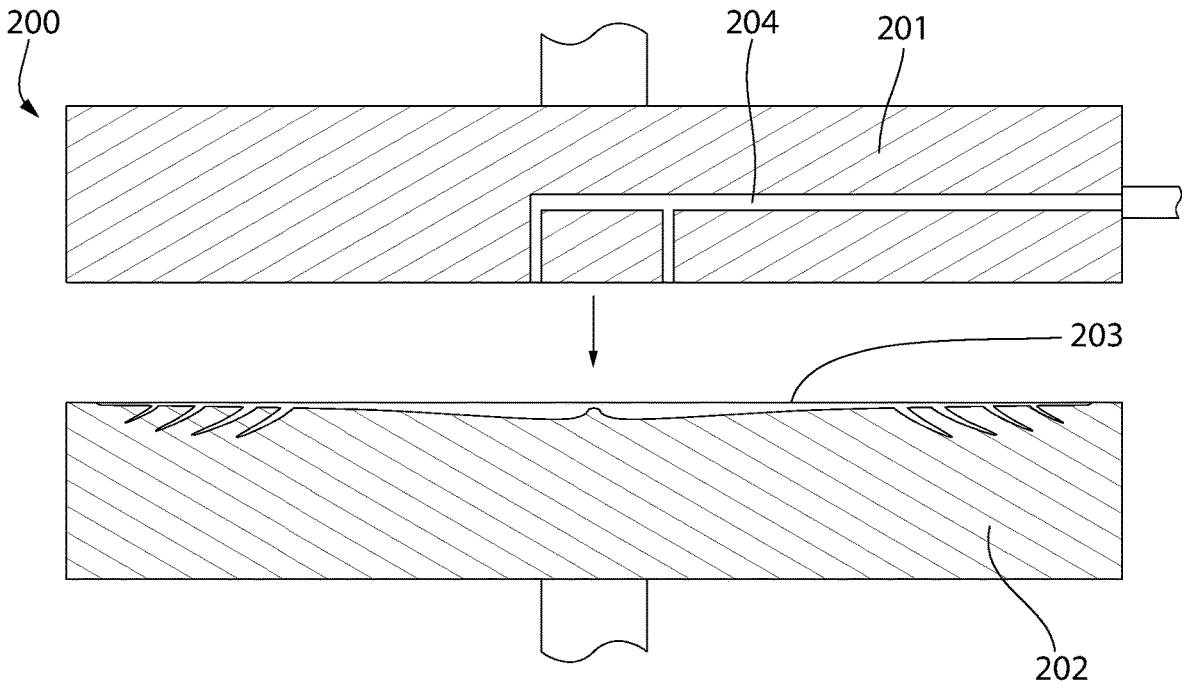
FIGS. 3A-3C are schematic views illustrating a process for manufacturing an interdental cleaning element of the oral care implement of FIG. 1.
Figure 3B:
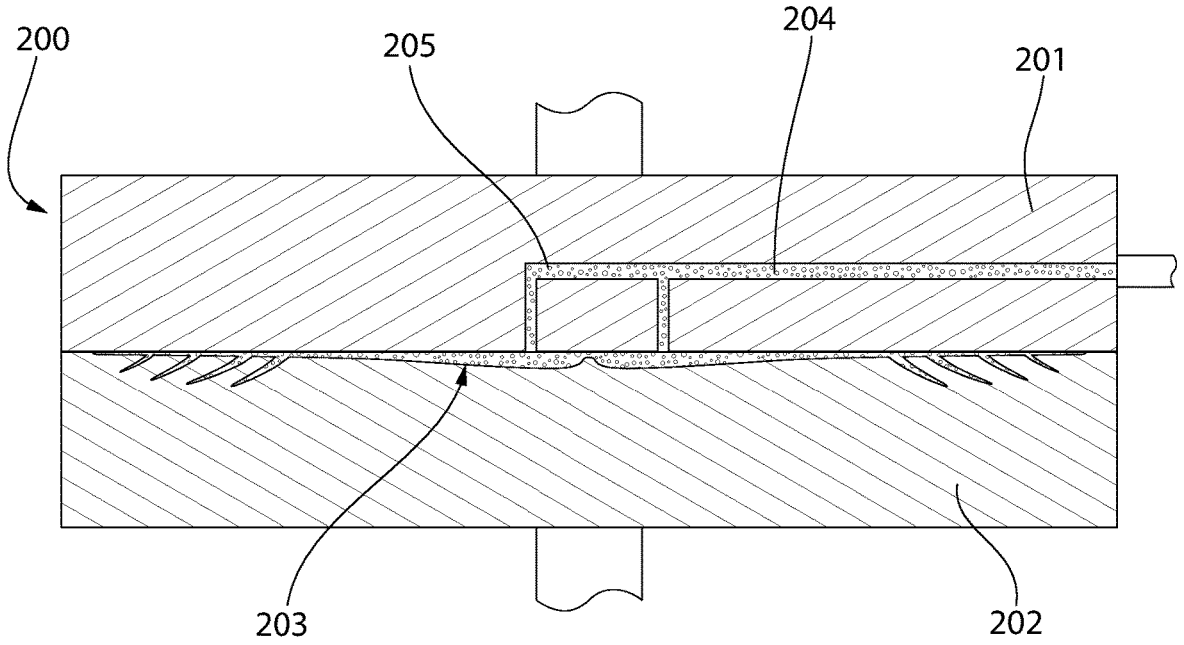
Figure 3C:
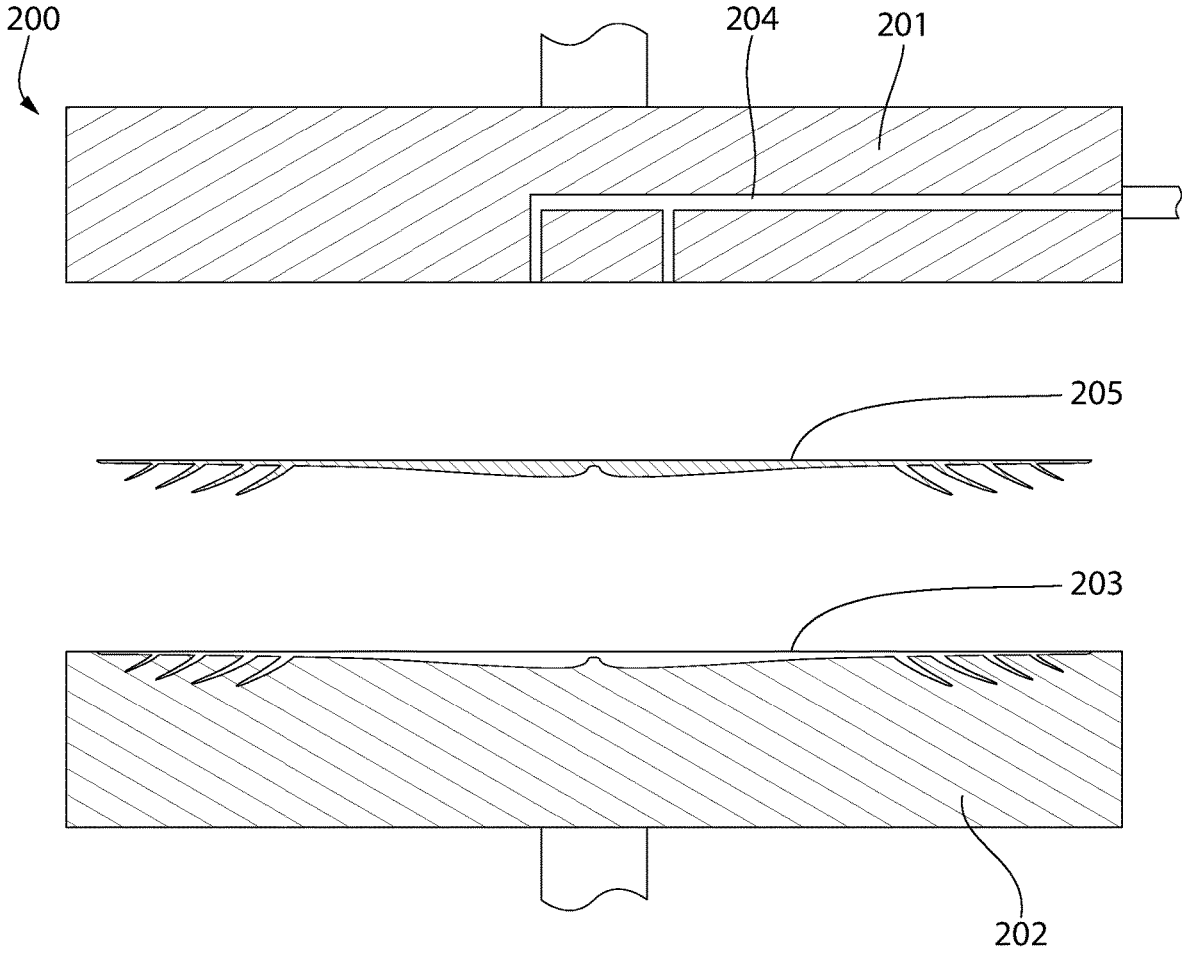

FIGS. 3A-3C illustrate one process for manufacturing one of the third tooth cleaning elements 150 (also referred to herein as interdental cleaning elements). In this embodiment, the third tooth cleaning elements 150 are manufactured separate from the oral care implement 100 and then later coupled to the oral care implement 100. Another process for manufacturing the third tooth cleaning elements will be discussed below with reference to FIGS. 8A-8D. In FIGS. 8A-8D, the third tooth cleaning elements are injection molded directly onto the head (or head plate) of the oral care implement and thus there is no separate step needed to couple the third tooth cleaning elements to the head.

Referring to FIGS. 3A and 3B, a mold 200 for injection molding the third tooth cleaning elements 150 is illustrated schematically. The mold comprises a first mold half 201 and a second mold half 202. The first and second mold halves 201, 202 may be movable relative to one another between an open state (FIG. 3A) and a closed state (FIG. 3B). This may be achieved by having one of the first and second mold halves 201, 202 be movable or both of the first and second mold halves 201, 202 may be separately movable. Thus, one or both of the first and second mold halves 201, 202 may be operably coupled to an actuator that is configured to move the first and/or second mold halves 201, 202 as needed to alter the first and/or second mold halves 201, 202 between the open and closed states. When the first and second mold halves 201, 202 are in the closed state, the first and second mold halves 201, 202 collectively define a mold cavity 203 having the shape of one of the third tooth cleaning elements 150. Thus, the third tooth cleaning elements 150 may be manufactured via injection molding the third material into the mold cavity 203.

In the exemplified embodiment, there are runners 204 formed into the first mold half 201. However, the invention is not to be so limited and the runners 204 may be formed into the second mold half 202 or there may be runners formed into both of the first and second mold halves 201, 202. The runners 204 may be cold runners or hot runners as desired. The runners 204 are operably coupled to a source of the third material (not illustrated) so that the third material may flow through the runners 204 into the mold cavity 203. The third material is preferably heated to melt before it flows through the runners 204 and into the mold cavity 203. However, ultrasonic molding techniques may be utilized whereby the third material is melted within the runners 204 and/or within the mold cavity 203.

FIG. 3B illustrates the mold 200 in operation such that the first and second mold halves 201, 202 are in the closed state and the third material 205 is flowing into the mold cavity 203 via the runners 204. The operation continues until the mold cavity 203 is completely filled with the third material 205. Once filled, the first and second mold halves 201, 202 remain in the closed state a sufficient amount of time for the third material 205 to cool and harden within the mold cavity 203. Once cooled and hardened, the third material 205 within the mold cavity 203 forms one of the third tooth cleaning elements 250.

Referring to FIG. 3C, once the third material 205 has cooled, the first and second mold halves 201, 202 are actuated into the open state and the third tooth cleaning element 150 is removed from the mold cavity 203. At this point in the process, the third tooth cleaning element 150 is ready to be coupled to the head 120 of the oral care implement 100. However, before discussing the steps related to coupling the third tooth cleaning element 150 to the head 120, the structural details of the third tooth cleaning element 150 will be described.

Figure 4:
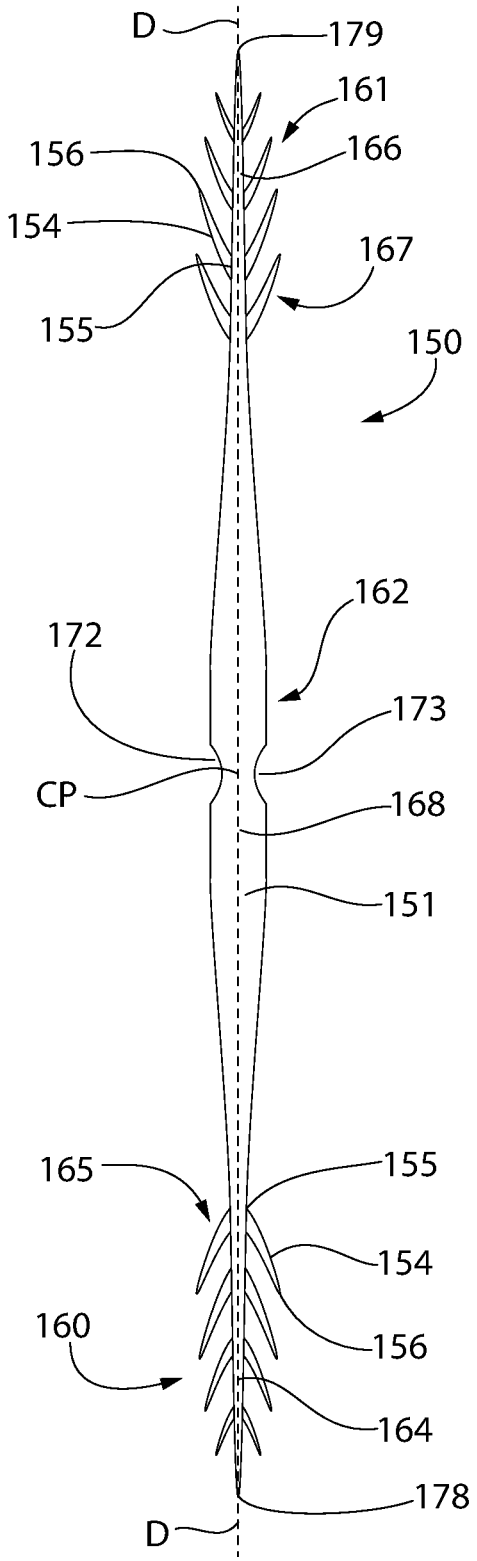
FIG. 4 is a perspective view of the interdental cleaning element of the oral care implement of FIG. 1 in an unfolded state.
Figure 5:
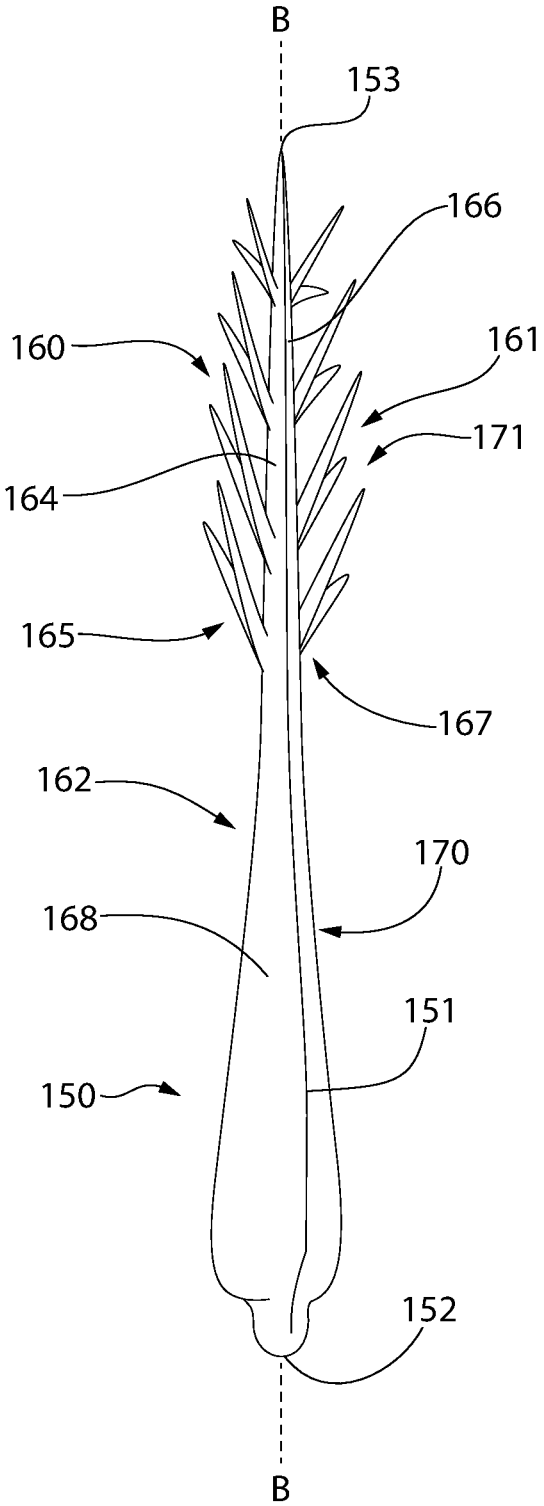
FIG. 5 is a front view of the interdental cleaning element of FIG. 4 in a folded state.

Referring to FIGS. 4 and 5, the structure of the third tooth cleaning element 150 will be described. FIG. 4 illustrates the third tooth cleaning element 150 in an unfolded state, which is the form in which it is manufactured. FIG. 5 illustrates the third tooth cleaning element 150 in a folded state, which is the form in which it is coupled to the head 120. In the exemplified embodiment, the third tooth cleaning element 150 can be altered from the unfolded state to the folded state by folding the third tooth cleaning element 150 along its axial center-point CP. In other embodiments, the third tooth cleaning element 150 may be folded at other locations as may be desired. As noted above, the third tooth cleaning element 150 comprises a body 151 and a plurality of tines 154 extending from the body 151. Each of the tines 154 extends from a first end 155 that is coupled to the body 151 to a second end 156 that is free and unattached. The tines 154 extend from the body 151 at an oblique angle. Stated another way, the tines 154 are elongated along an axis that is oblique to the longitudinal axis B-B of the body 151.

The third tooth cleaning element 150 comprises a first portion 160, a second portion 161, and a third portion 162. When the third tooth cleaning element 150 is in the unfolded state, the third portion 162 is located axially between the first and second portions 160, 161 such that the first and second portions 160, 161 are axially spaced apart from one another. The first portion 160 of the third tooth cleaning element 150 comprises a first portion 164 of the body 151 and a first set of the tines 165. The second portion 161 of the third tooth cleaning element 150 comprises a second portion 166 of the body 151 and a second set of the tines 167. The third portion 162 of the third tooth cleaning element 150 comprises a third portion 168 of the body 151. The third portion 168 of the body 151 does not have any tines extending therefrom. Thus, the third portion 162 of the third tooth cleaning element 150 is free of any tines.

In the unfolded state, the third tooth cleaning element 150 extends from a first end 178 to a second end 179 along an axis D-D. The first portion 164 of the body 151 comprises the first end 178 and the second portion 166 of the body 151 comprises the second end 179. The first set of the tines 165 extend from the body 151 towards the first end 178 of the body 151 and the second set of the tines 167 extend from the body 151 towards the second end 179 of the body 151. Thus, in the unfolded state, the first and second sets of the tines 165, 167 extend in opposite directions. Once folded, the first and second sets of tines 165, 167 extend in the same direction.

When in the folded state (the state in which it is coupled to the head 120), the third tooth cleaning element 150 comprises a lower axial section 170 and an upper axial section 171. The lower axial section 170 is the section of the third tooth cleaning element 150 that does not have any tines. Thus, the lower axial section 170 corresponds to the third portion 162 of the third tooth cleaning element 150. The upper axial section 171 is the section of the third tooth cleaning element 150 that includes the tines 154. Thus, the upper axial section 171 corresponds to the first and second portions 160, 161 of the third tooth cleaning element 150. When the third cleaning element 150 is coupled to the head 120 (as discussed below with specific reference to FIG. 7), the lower axial section 170 is the section closer to the front surface 121 of the head 120 and the upper axial section 171 is the section that is further from the front surface 121 of the head 120.

The third tooth cleaning element 150 is altered from the unfolded state to the folded state by folding the third tooth cleaning element 150 along the third portion 162. In the exemplified embodiment, the third portion 162 comprises a first notch 172 and a second notch 173 adjacent to an axial center-point CP of the third portion 162, which is also the axial center-point CP of the third tooth cleaning element 150. The first and second notches 172, 173 make it easier to fold the third tooth cleaning element 150 by reducing the amount of material that needs to be folded.

Figure 6A:
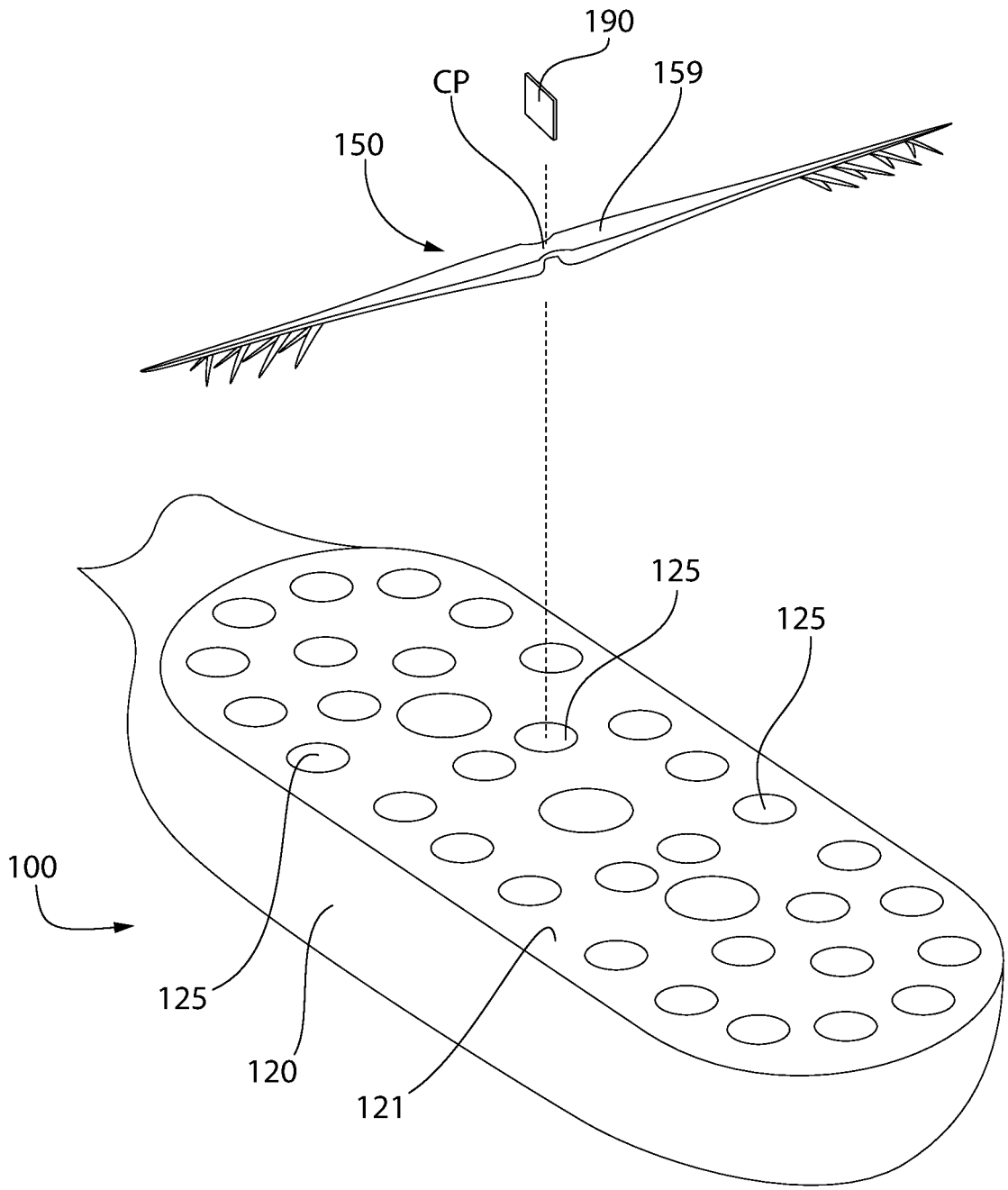
FIGS. 6A and 6B illustrated a process for coupling the interdental cleaning element of FIG. 3 to the head of the oral care implement of FIG. 1.

Referring to FIG. 6A, one of the third tooth cleaning elements 150 is illustrated in preparation for being coupled to the head 120 of the oral care implement 100. Specifically, there are a plurality of holes 125 formed into the front surface 121 of the head 120. Each of the third tooth cleaning elements 150 is configured to be placed at least partially within one of the holes 125 and then coupled to the head 120. Specifically, the third tooth cleaning elements 150 are configured to be coupled to the head 120 with a connection member 190. In the exemplified embodiment, the connection member 190 is a flat, square or rectangular shaped member that is referred to in the art as a staple or anchor. However, the connection member 190 is not limited to being a flat staple/anchor as illustrated, but can take on other shapes in other embodiments so long as the connection member 190 is configured to secure the third tooth cleaning elements 150 within one of the holes 125. Thus, the connection member 190 could be a traditional U-shaped staple, an adhesive, or the like in other embodiments.

Figure 6B:
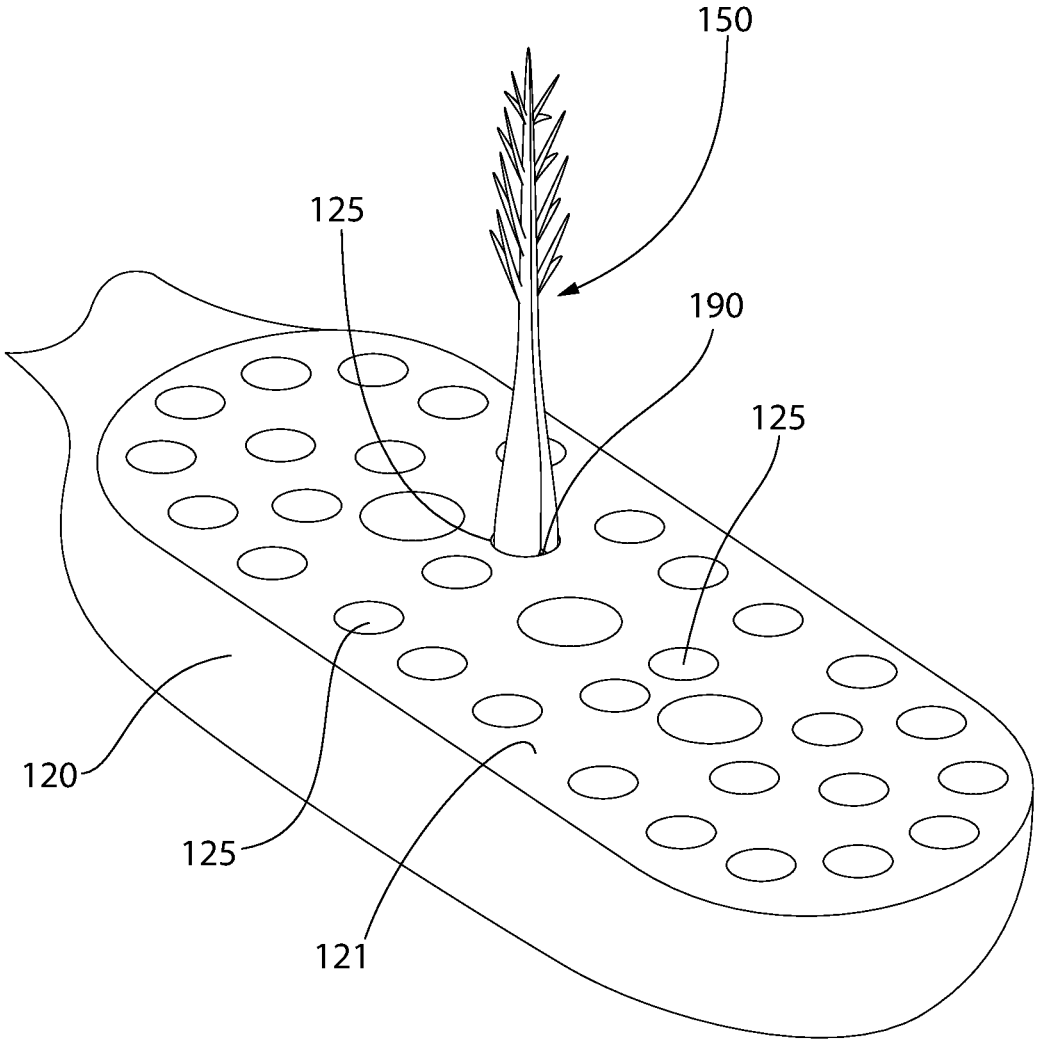

Referring to FIGS. 6A and 6B concurrently, the connection member 190 is placed adjacent to an inner surface 159 of the third tooth cleaning element 150 along the axial center-point CP. The third tooth cleaning element 150 is then folded around the connection member 190 and the third tooth cleaning element 150 and the connection member 190 are inserted into one of the holes 125. The connection member 190 preferably has a length that is slightly greater than the diameter of the hole 125 so that the connection member 190 secures the third tooth cleaning element 150 to the head 120 within the hole 125. FIG. 6B illustrates one of the third tooth cleaning elements 150 secured within one of the holes 125 so that the third tooth cleaning element 150 extends from the front surface 121 of the head 120.

Figure 6C:
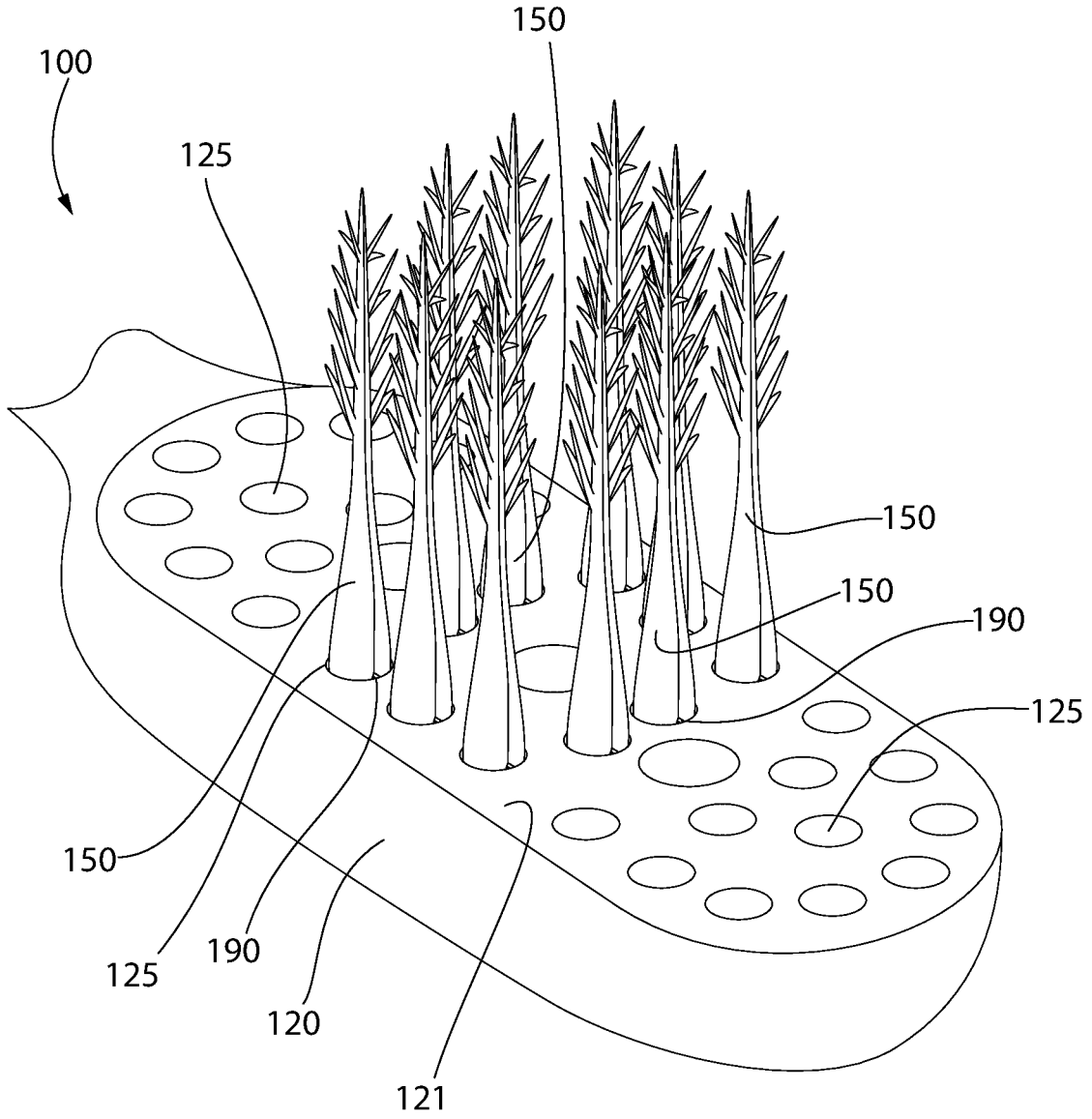
FIG. 6C is a perspective view illustrating a plurality of the interdental cleaning elements of FIG. 3 coupled to the head of the oral care implement of FIG. 1.

Referring to FIG. 6C, a plurality of the third tooth cleaning elements 150 are illustrated coupled to the head 120 and extending from the front surface 121 of the head 120. Each of the third tooth cleaning elements 150 is coupled to the head 120 within one of the holes 125 using one of the connection members 190. In the exemplified embodiment, the third tooth cleaning elements 150 are all located within a center region of the head 120 of the oral care implement 100. However, the invention is not to be so limited in all embodiments and the particular location along the head 120 at which the third tooth cleaning elements 150 are positioned is not to be limiting of the present invention. In some embodiments, the third tooth cleaning elements 150 may be positioned at a proximal or distal region of the head 120. In some embodiments, there may only be a single third tooth cleaning element 150 on the head 120 at any desired location.

Referring briefly to FIG. 2, in the exemplified embodiment the first tooth cleaning elements 130 are located within a proximal region and a distal region of the head 120 and the third tooth cleaning elements 150 are located within a central region of the head 120. Thus, in the exemplified embodiment the third tooth cleaning elements 150 are at least partially surrounded by the first tooth cleaning elements 130. Furthermore, in the exemplified embodiment the third tooth cleaning elements 150 are arranged so as to surround at least one of the second tooth cleaning elements 140. However, unless specified in the claims, the specific arrangement and pattern of the first, second, and third tooth cleaning elements 130, 140, 150 is not to be limiting of the present invention and other arrangements and patterns may be used. For example, the third tooth cleaning elements 150 may be positioned on a distal portion of the head 120, on a proximal portion of the head 120, in rows extending laterally across the head 120, in rows extending axially across the head 120 between the proximal and distal ends of the head 120, or the like.

Figure 7:
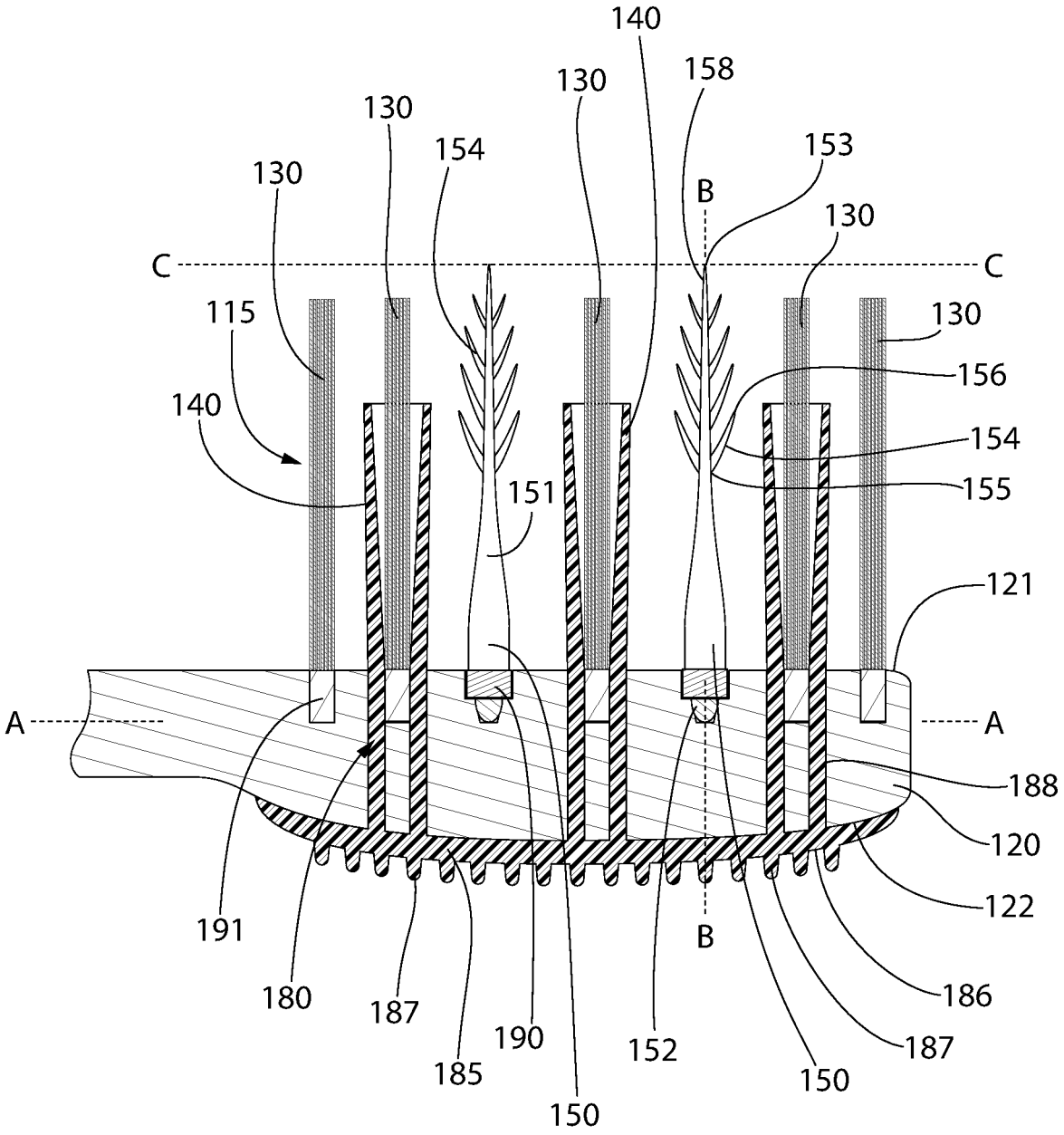
FIG. 7 is a cross-sectional view taken along line VII-VII of FIG. 2.

FIG. 7 is a schematic cross-sectional view taken through the head 120 of the oral care implement 100. At some point, either before or after the third tooth cleaning elements 150 are coupled to the head 120, the first and second tooth cleaning elements 130, 140 are also coupled to the head 120. In this embodiment, the first tooth cleaning elements (i.e., bristles) 130 are coupled to the head 120 using connection elements 191. Specifically, the first tooth cleaning elements 130 are bundled into tufts, folded into a U-shape, and then secured within one of the holes 125 using the connection elements 191.

In this embodiment, the second tooth cleaning elements 140 are injection molded onto the head 120. Specifically, as shown in FIG. 7 the head 120 includes passageways 180 that extend from the front surface 121 of the head 120 to the rear surface 122 of the head 120. The second material is injected onto the head 120 so that a unitary mass of the second material forms the second tooth cleaning elements 140 that extend from the front surface 121 of the head 120 and a soft tissue cleaner 185 that is positioned on the rear surface 122 of the head 120. The soft tissue cleaner 185 comprises a pad portion 186 that is affixed to the rear surface 122 of the head 120 and a plurality of nubs 187 protruding from the pad portion 186 for effectuating cleaning of a user's tongue and soft tissue surfaces. The unitary mass of the second material also includes an anchor portion 188 located within the passageways 180. Of course, the soft tissue cleaner 185 need not be included in all embodiments and it may be omitted. In embodiments that omit the soft tissue cleaner 185, the head 120 may have additional passages or conduits that extend substantially perpendicularly from the passageways 180. During manufacture, the second material may flow into these additional passages or conduits so that upon cooling and hardening the second tooth cleaning elements 140 are coupled to the head 120 and will remain coupled to the head 120 even during a strenuous toothbrushing regimen.

As noted above, the body 151 of the third tooth cleaning element 150 extends from the proximal end 152 to the distal end 153 along the longitudinal axis A-A. Furthermore, each of the tines 154 extends from the body 151 at an oblique angle relative to the longitudinal axis A-A. Specifically, the tines 154 extend away from the front surface 121 of the head 120 as they extend further from the body 151. Thus, the second ends 156 (free ends) of the tines 154 are located further from the front surface 121 of the head 120 than the first ends 155 of the tines 154. Furthermore, each of the tines 154 has a length measured from the first end 155 to the second end 156 of that tine 154. The lengths of the tines 154 get progressively shorter the closer the tine 154 is to the distal end 153 of the body 151. Stated another way, the tines 154 that are further from the distal end 153 of the body 151 are longer than the tines 154 that are closer to the distal end 153 of the body 151. In an alternative embodiment, all of the tines 154 may have the same length. In the exemplified embodiment, each of the tines 154 tapers from the first end 155 to the second end 156.

Furthermore, as noted above the body 151 comprises the lower axial section 170 which is free of tines and the upper axial section 171 which is the section of the body 151 from which the tines 154 extend. In the exemplified embodiment, the upper axial section 171 of the body 151 tapers towards the distal end 153 of the body 151. In the exemplified embodiment, the upper axial section 171 tapers continuously along its entire length. Thus, as the length of the tines 154 is decreasing, so is the diameter or thickness of the body 151. This makes it easier for the third tooth cleaning elements 150 to enter into the interdental spaces. In the exemplified embodiment, the upper axial section 171 of the body 151 tapers to a point at the distal end 153. However, in other embodiments the distal end 153 of the body 151 may be rounded rather than pointed as shown. In the exemplified embodiment, the lower axial section 170 of the body 151 also tapers for a portion of its length, although the lower axial section 170 may taper along its entire length or not at all in alternative embodiments.

In the exemplified embodiment, all of the tines 154 are located along the body 151 at a position between the proximal end 152 and the distal end 153 of the body 151 (the proximal and distal ends 152, 153 being defined with the third tooth cleaning element 150 in the folded state and coupled to the head 120). Thus, the body 151 comprises a distal portion 158 that is located between an upper-most one of the tines 154 and the distal end 153 of the body 151. There are no tines extending from the body 151 along the distal portion 158. Furthermore, no portion of any of the tines 154 extends beyond a reference plane C-C that is parallel to the front surface 121 of the head 120 that intersects the distal ends 153 of the bodies 151 of the third tooth cleaning elements 150. Thus, the tines 154 protrude from the outer surface of the body 151 but do not extend to a height (measured from the front surface 121 of the head 120) above the distal end 153 of the body 151. Stated another way, an entirety of each of the tines 154 is located between the reference plane C-C and the proximal end 152 of the body 151.

In the exemplified embodiment, when the third tooth cleaning elements 15 are in the folded state, the third tooth cleaning elements 150 are elongated along the longitudinal axis B-B. Furthermore, the body 151 of the third tooth cleaning elements 150 has a generally conical or cylindrical shape. In the exemplified embodiment the body 151 of the third tooth cleaning elements 150 has a round (i.e., circular, oval, or similar) transverse cross-sectional shape. However, the invention is not to be so limited and the body 151 may have a square, rectangular, or other polygonal transverse cross-sectional shape in other embodiments.

As best shown in FIG. 7, the third tooth cleaning elements 150 have a height measured from the front surface 121 of the head 120 to the distal ends 153 of the third tooth cleaning elements 150 that is greater than a height of the first tooth cleaning elements 130 and a height of the second tooth cleaning elements 140. In the exemplified embodiment, the height of the third tooth cleaning elements 150 is greater than the height of the first tooth cleaning elements 130 and the height of the third tooth cleaning elements 140 is greater than the height of the second tooth cleaning elements 140. In other embodiments, the height of the second tooth cleaning elements 140 may be greater than the height of the first tooth cleaning elements 130. Furthermore, the height of the first and third tooth cleaning elements 130, 150 may be the same in some embodiments. However, having the height of the third tooth cleaning elements 150 be greater than the heights of the first and second tooth cleaning elements 130, 140 may be preferable in some embodiments to facilitate interdental cleaning using the third tooth cleaning elements 150.

Referring to FIGS. 8A-8D, a method of forming a third tooth cleaning element 250 will be described in accordance with another embodiment of the present invention. The third tooth cleaning element 250 has a different reference numeral than the third tooth cleaning element 150 previously described. However, when installed on the head of an oral care implement, the third tooth cleaning element 250 has an identical structure to the third tooth cleaning element 150. Thus, the structural and material description of the third tooth cleaning element 150 is applicable to the third tooth cleaning element 250. The difference between the third tooth cleaning element 250 and the third tooth cleaning element 150 is in the manner in which it is formed.

Figure 12A:
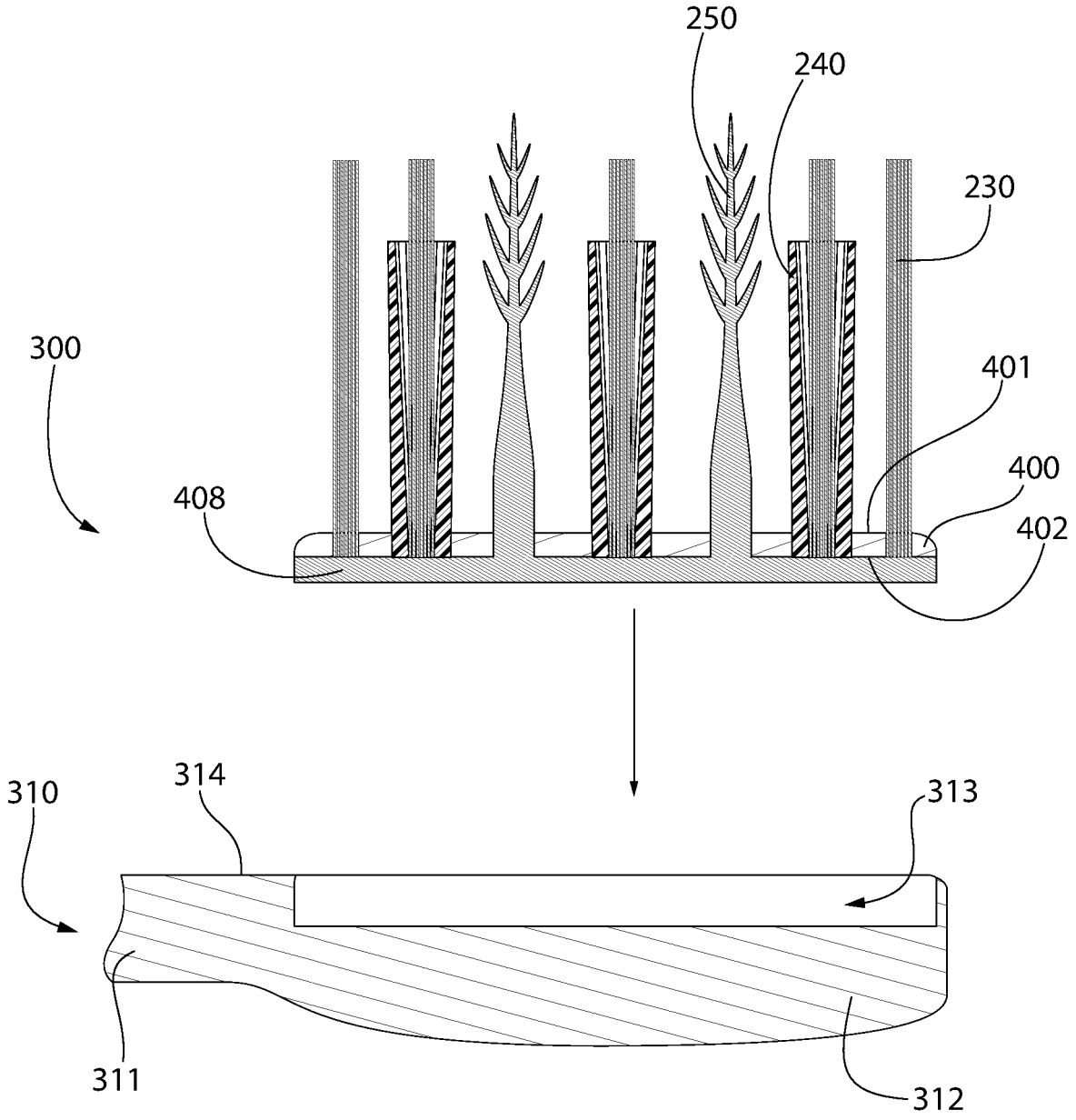
FIGS. 12A and 12B illustrate a process for coupling the head plate of FIG. 11 to a head portion of a body of an oral care implement.

Referring briefly to FIG. 12A, an oral care implement 300 is illustrated. The oral care implement 300 comprises a body 310 comprising a handle portion 311 and a head portion 312 (only a portion of the handle portion 311 is shown in the drawings). Furthermore, the oral care implement 300 comprises a head plate 400 that is formed separate from the body 310. The head plate 400 is coupled to the head portion 312 of the body 310 to form a head 320 of the oral care implement 300 (see FIG. 12B). As will be discussed in more detail below, the tooth cleaning elements are coupled to the head plate 400 and then the head plate 400 is coupled to the head portion 312 of the body 310 to form the head 320 of the oral care implement 300.

Referring to FIGS. 8A-8D, in this embodiment, the third tooth cleaning element 250 is injection molded directly onto the head plate 400 rather than being formed separately from the head and then later coupled to the head using connection elements as with the embodiment previously described. The head plate 400 comprises a front surface 401 and a rear surface 402 opposite the front surface 401. Furthermore, the head plate 400 comprises a plurality of holes 403 extending through the head plate 400 from the front surface 401 to the rear surface 402.

In this embodiment, a first mold 410 is provided that comprises one or more first mold cavities 411 having the shape of the third tooth cleaning elements 250. In the exemplified embodiment, the first mold 410 comprises a central mold part 415, a first side mold part 416, a second side mold part 417, and a bottom mold part 418. In the exemplified embodiment, the central mold part 415 and the first and second side mold parts 416, 417 collectively form the mold cavities 411 and the bottom mold part 418 forms a cavity for receiving/holding the head plate 400. Despite the specific embodiment illustrated, the specific number of parts that the first mold 410 comprises will be dictated by the number and location of the third tooth cleaning elements 250.

Figure 8A:
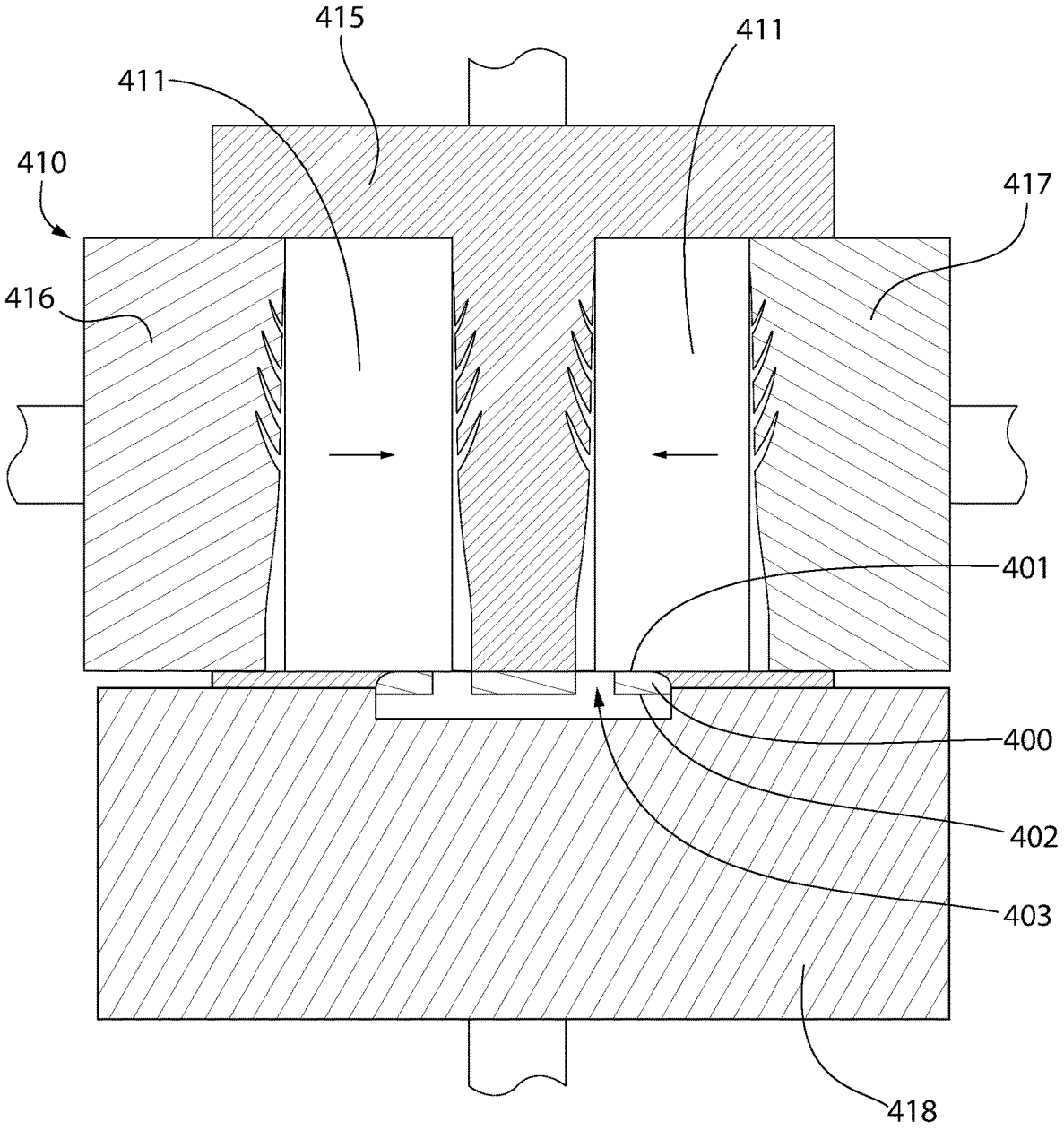
FIGS. 8A-8D illustrate a process for coupling an interdental cleaning element to a head plate in accordance with an embodiment of the present invention.
Figure 8B:
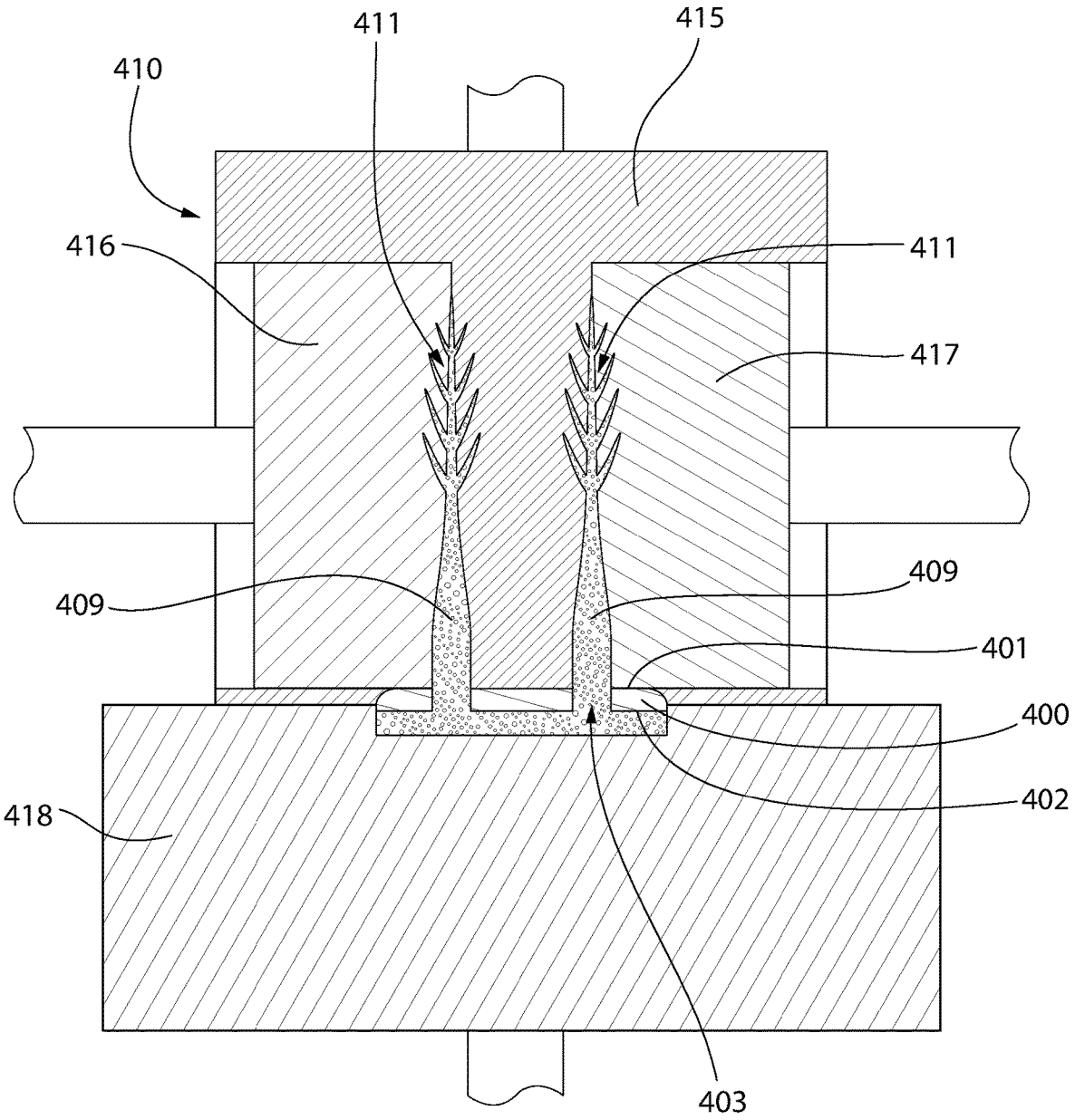

In the exemplified embodiment, the first and second side mold parts 416, 417 are alterable from an open state (FIG. 8A) into a closed state (FIG. 8B). In the closed state, each of the first mold cavities 411 is aligned with one of the holes 403 in the head plate 400 so that the third tooth cleaning elements 250 can be injection molded directly into the holes 403 in the head plate 400. Referring to FIG. 8B, once the first mold 410 is altered into the closed state, a third material 409 flows through runners (not illustrated in this view) in the first mold 410 until the first mold cavities 411 are filled with the second material. Next, the second material is allowed to cool and harden, thereby forming the third tooth cleaning elements 250. At this stage, the first mold 410 can be altered back into the open state (FIG. 8C) and then moved away from the head plate 400 (FIG. 8D) so that the head plate 400 can be removed from the first mold cavities 410 for use in forming the oral care implement 300.

Figure 8C:
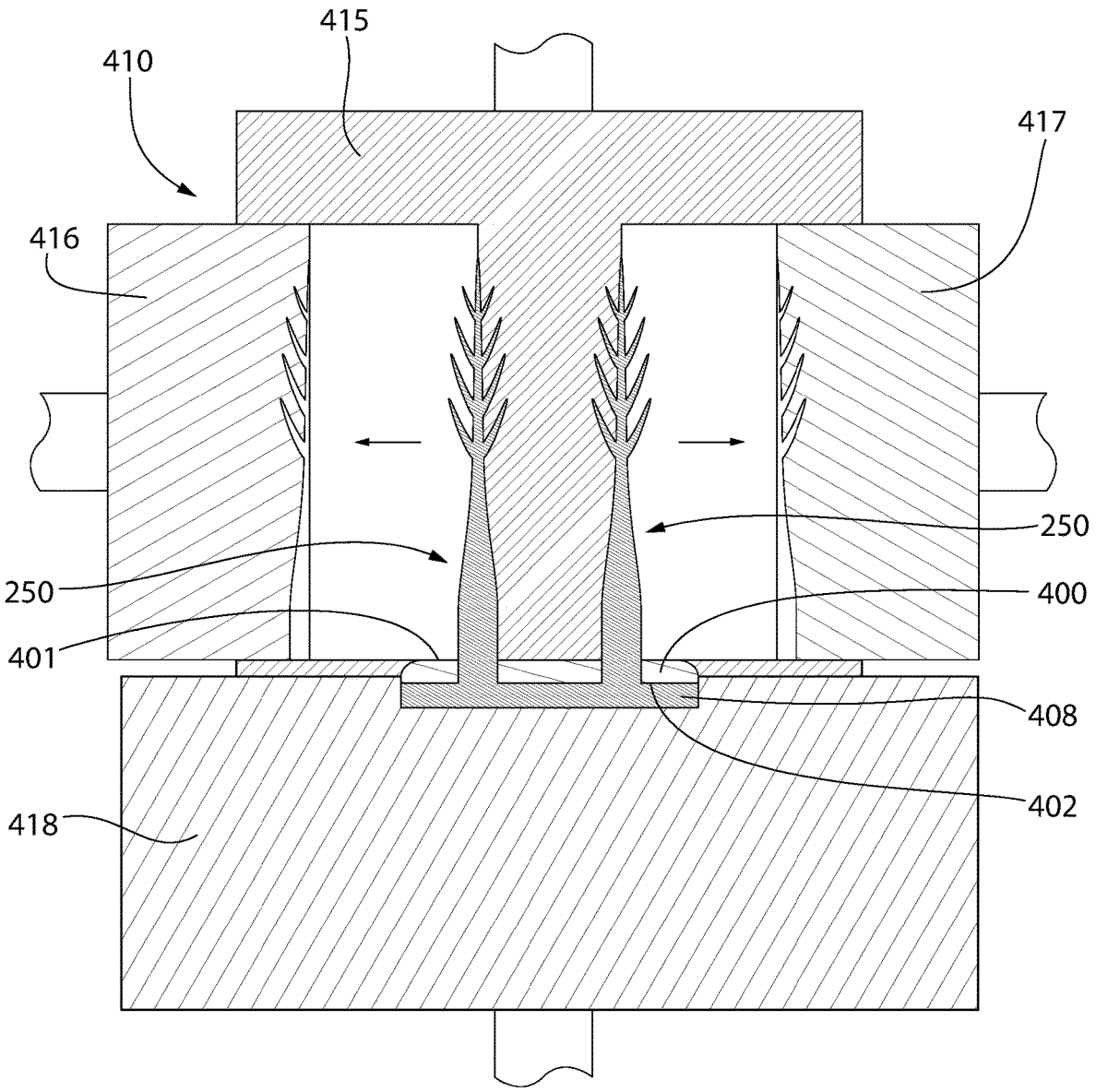

Referring to FIG. 8C, in this embodiment a portion of the second material forms a melt matte 408 that is adjacent to the rear surface 402 of the head plate 400. This prevents the third tooth cleaning elements 250 from being readily detached from the head plate 400, particularly after the head plate 400 is attached to the head portion 312 of the body 310 as discussed below.

Figure 8D:
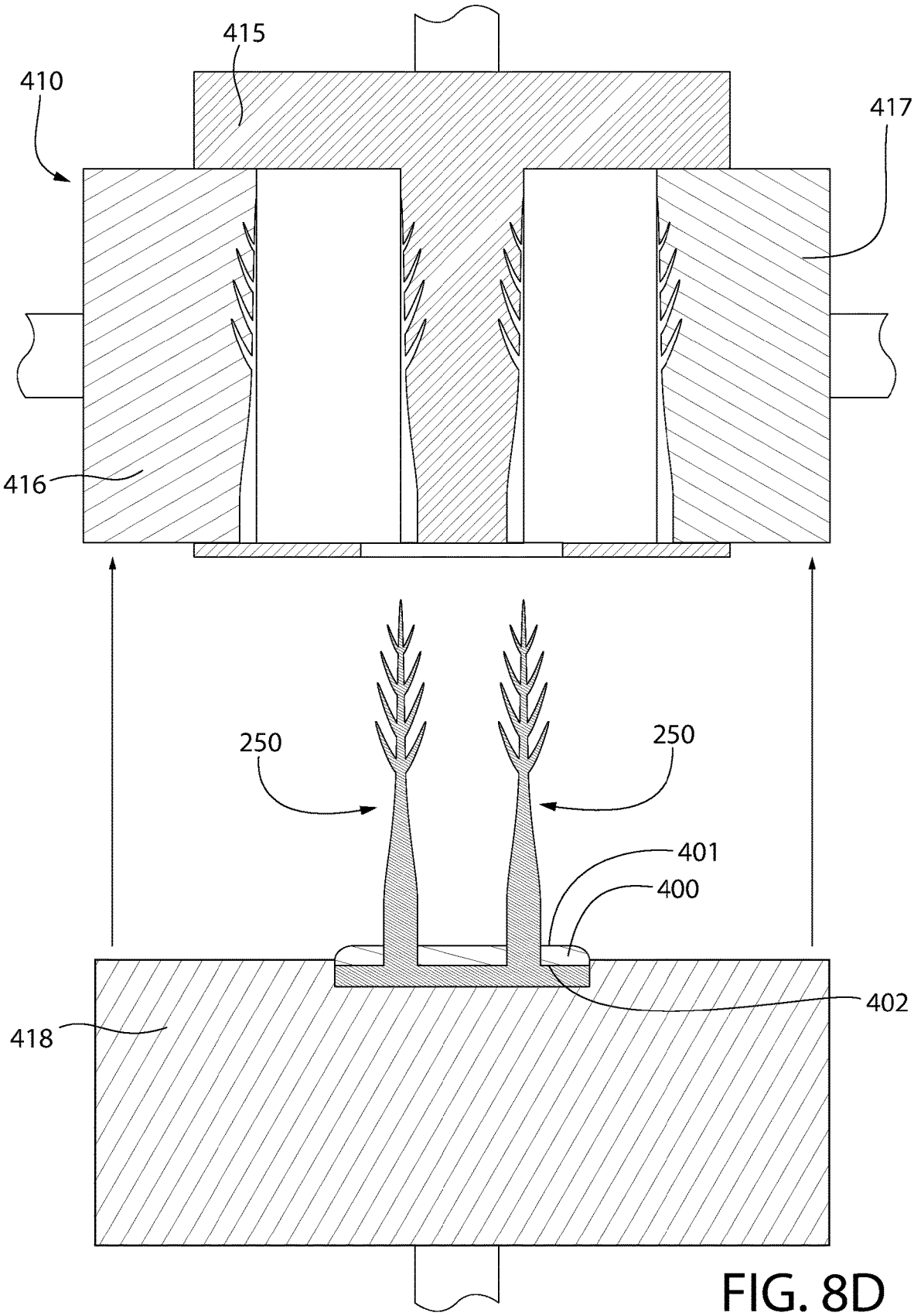
Figure 9A:
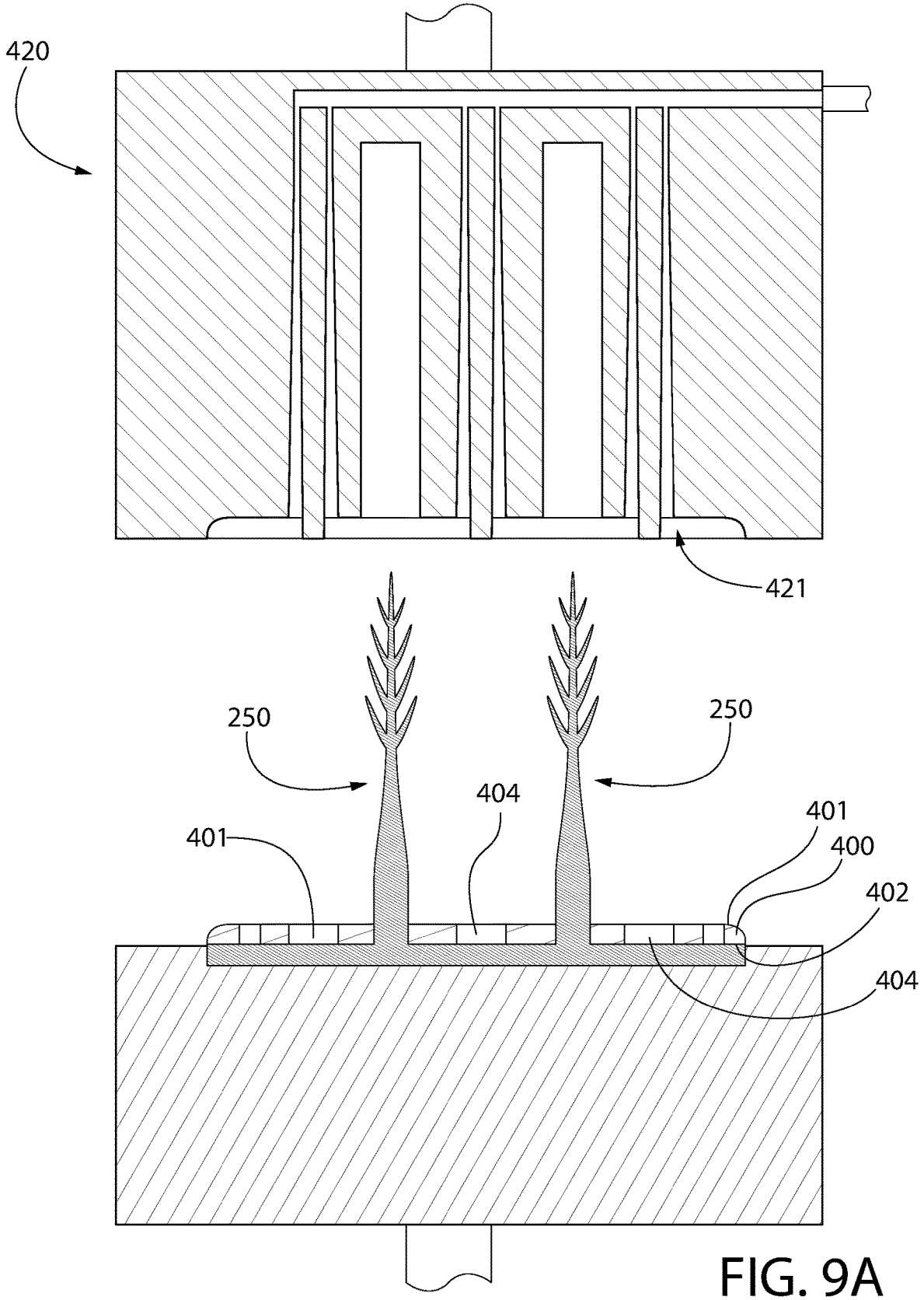
FIGS. 9A-9C illustrate a process for coupling a lamella to the head plate.
Figure 9B:
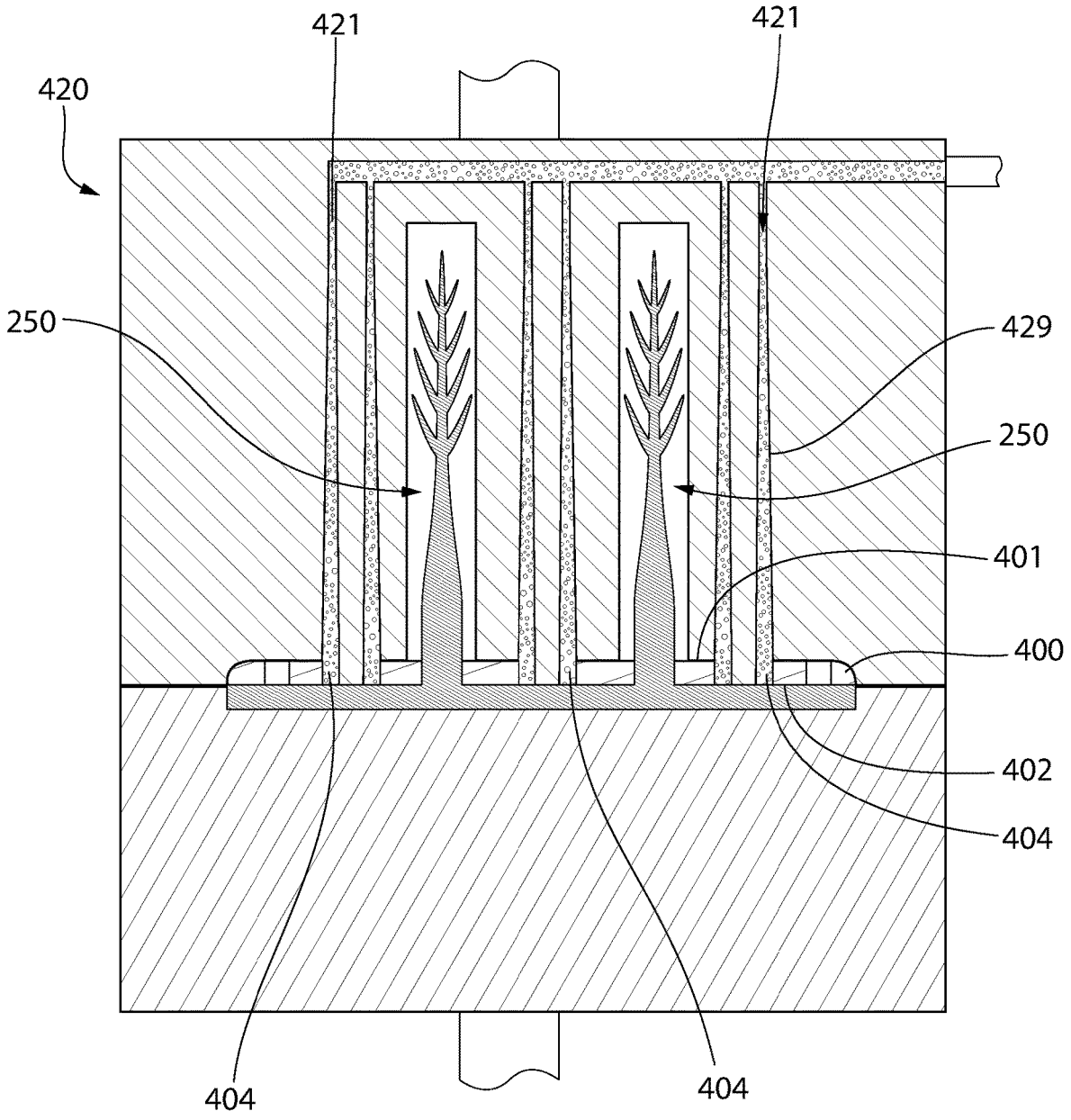
Figure 9C:
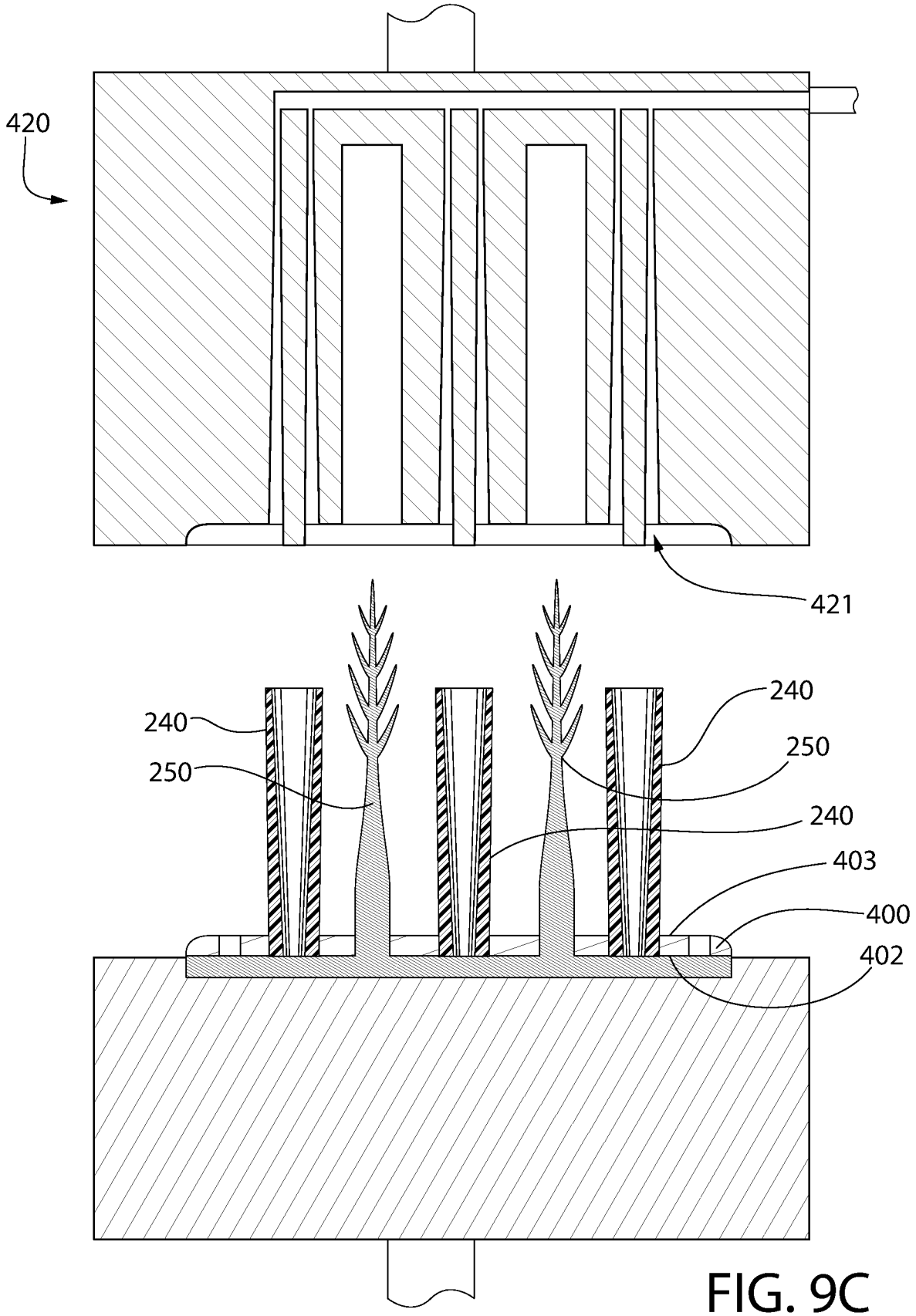

In some embodiments, after the step shown in FIG. 8D, the head plate 400 with the third tooth cleaning elements 250 coupled thereto may be ready for coupling to the head portion 312 of the body 310 to form the head 320. However, in other embodiments additional tooth cleaning elements may still need to be coupled to the head plate 400. For example, referring to FIGS. 9A-9C, the head plate 400 with the third tooth cleaning elements 250 coupled thereto may be placed within a second mold cavity 421 of a second mold 420 so that additional holes 404 of the head plate 400 are aligned with the second mold cavities 421. Next, as shown in FIG. 9B, a second material 429 may be injected into the second mold cavities 421 to form second tooth cleaning elements 240 (which are identical in structure and material to the second tooth cleaning elements 140 described above). Once the second material 429 cools and hardens, the second mold 420 may be altered into the open state (FIG. 9C) so that the head plate 400 can be removed from the second mold cavity 421.

In one embodiment, during the molding of the third tooth cleaning elements 250 using the third material 409, a plurality of molded bristles may also be formed. Thus, the third material 409 (i.e., thermoplastic polyurethane) may be used to simultaneously form the third tooth cleaning elements 250 and one or more molded bristles having a more conventional bristle shape (i.e., a cylindrical shape, a conical shape, or similar). In some embodiments, the molded bristles may be located along a localized region of the head of the oral care implement. In such embodiments, there may also be PBT or nylon bristles on the head and/or lamella formed from a thermoplastic elastomer as described herein. In other embodiments, the head may include only the third tooth cleaning elements 250 and a plurality of the molded bristles such that all of the tooth cleaning elements on the head are formed of the same material (i.e., the third material 409).

Figure 10:
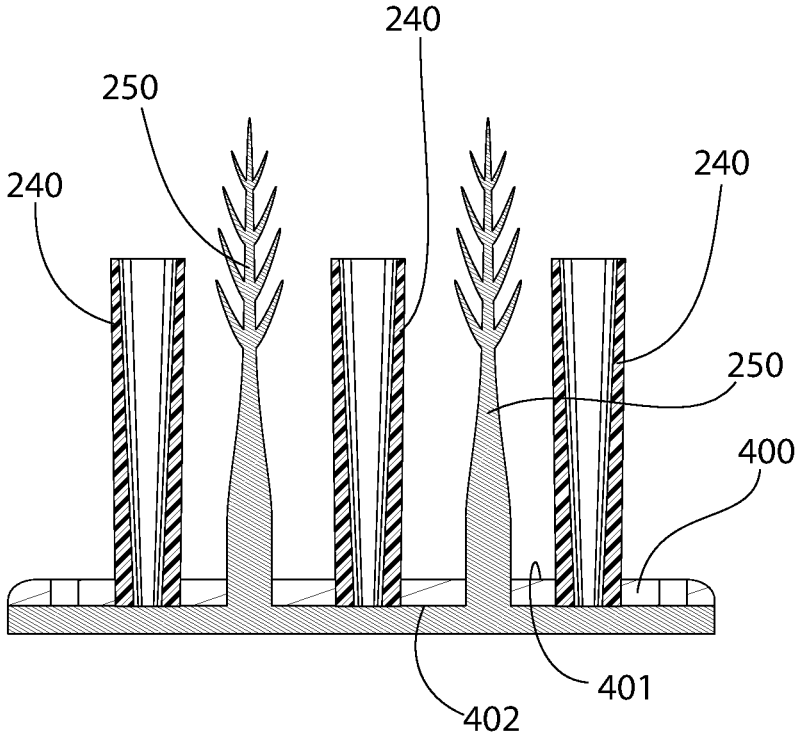
FIG. 10 illustrates the head plate of FIGS. 8A-9C with the interdental cleaning element and the lamella coupled thereto.

FIG. 10 illustrates the head plate 400 with the second and third tooth cleaning elements 240, 250 coupled thereto after having been injection molded directly onto the head plate 400. Although the exemplified embodiment utilizes a head plate, the invention is not to be so limited in all embodiments. Specifically, the second and third tooth cleaning elements 240, 250 could be injection molded directly onto a head of an oral care implement rather than using a head plate for this purpose. In either case, this should be achieved with a two-shot injection molding process because the second and third tooth cleaning elements 240, 250 are formed of different materials so separate shots are needed to form the different cleaning elements 240, 250 when both are included on the head.

Figure 11:
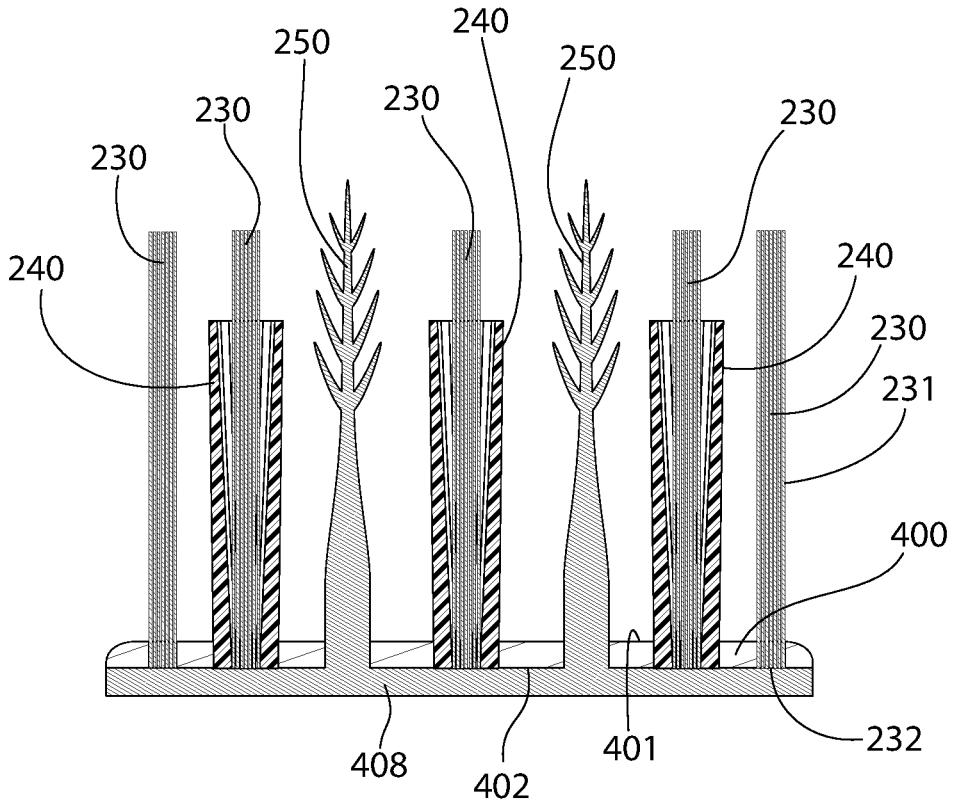
FIG. 11 illustrates the head plate of FIG. 10 with bristles also coupled thereto.

Next, referring to FIG. 11, a plurality of first tooth cleaning elements 230 may be coupled to the head plate 400. The first tooth cleaning elements 230 are identical in structure and material to the first tooth cleaning elements 130 described above. However, in this embodiment the first tooth cleaning elements 230 are coupled to the head plate 400 using anchor-free tufting techniques rather than using a separate connection element. Thus, the first tooth cleaning elements 230 are inserted through tuft holes in the head plate 400 so that first portions 231 of the first tooth cleaning elements 230 protrude from the first surface 401 of the head plate 400 and second portions 232 of the tooth cleaning elements 230 protrude from the second surface 402 of the head plate 400. The first portions 231 of the first tooth cleaning elements 230 perform the cleaning function. The second portions 232 of the first tooth cleaning elements 230 are heated and melted together so that the second portions 232 of the first tooth cleaning elements form a portion of the melt matte 408. In certain embodiments, the melt matte 408 may be formed from a collection of the first, second, and third materials that form the first, second, and third tooth cleaning elements 230, 240, 250. Upon coupling the first tooth cleaning elements 230 to the head plate 400, the head plate 400 is complete and ready for coupling to the head portion 312 of the body 310.

Figure 12B:
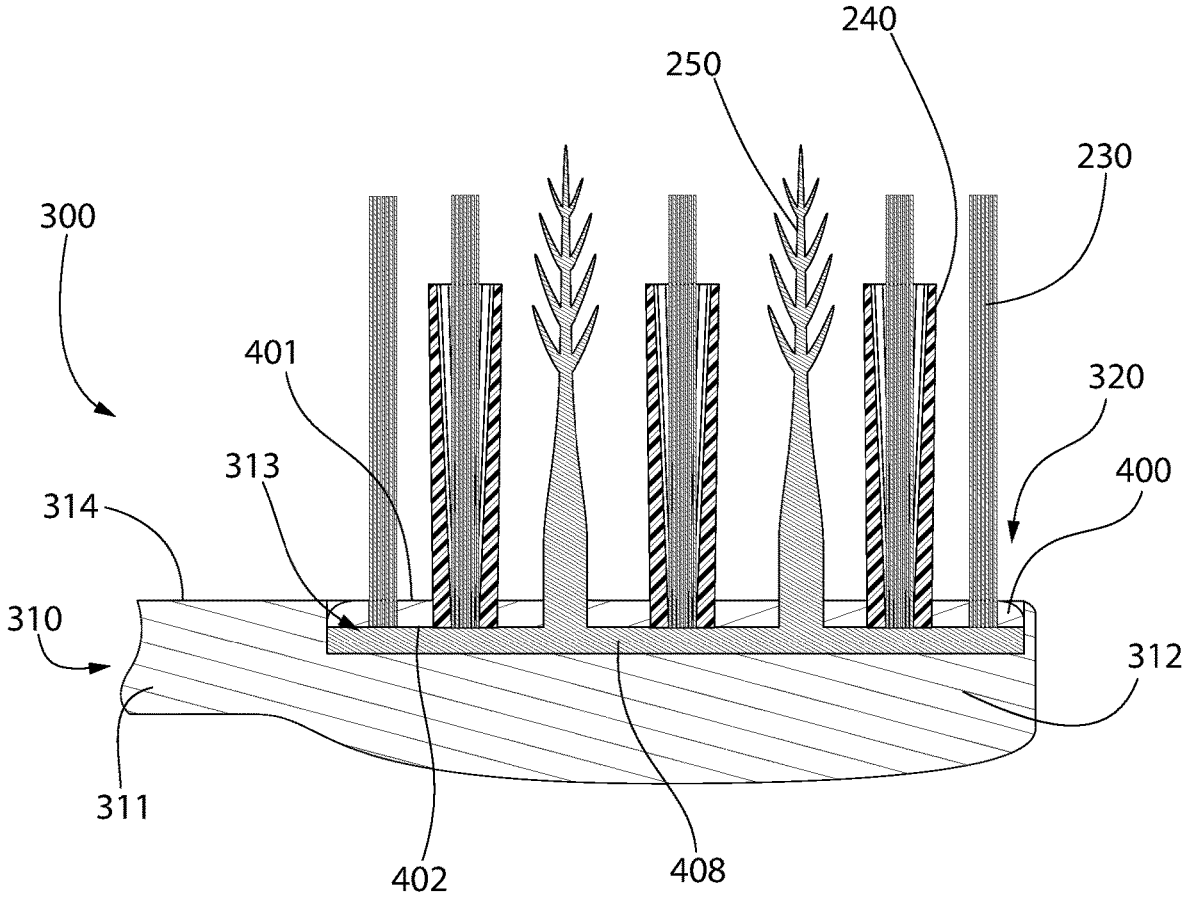

Referring to FIGS. 12A and 12B, the head plate 400 is illustrated being coupled to the head portion 312 of the body 310. The head portion 312 of the body 310 comprises a cavity 313 that is sized and configured to receive the head plate 400 therein. The cavity 313 may have a depth that is equal to the thickness of the head plate 400 and melt matte 408 so that the front surface 401 of the head plate 400 sits flush with a front surface 314 of the head portion 312 of the body 310. FIG. 12B illustrates the oral care implement 300 with the fully formed head 320, the head 320 comprising the head portion 312 of the body 310 and the head plate 400.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A molded tooth cleaning element comprising:

a body extending from a first end to a second end along a longitudinal axis, the body comprising a first portion that includes the first end, a second portion that includes the second end, and a third portion located between the first and second portions;

a first plurality of tines extending from the body at an oblique angle along the first portion of the body, the first plurality of tines extending towards the first end of the body;

a second plurality of tines extending from the body at an oblique angle along the second portion of the body, the second plurality of tines extending towards the second end of the body; and wherein the body is alterable between: (1) an unfolded state in which the first and second portions of the body are spaced apart from one another; and (2) a folded state in which the first and second portions of the body are aligned with and in contact with one another.

2. The molded tooth cleaning element according to claim 1 wherein in the unfolded state the first plurality of tines and the second plurality of tines extend from the body in opposite directions, and wherein in the folded state the first and second pluralities of tines extend from the body in the same direction.

3. The molded tooth cleaning element according to claim 1 wherein the third portion of the body is devoid of any tines extending therefrom.

4. The molded tooth cleaning element according to claim 1 wherein the first portion of the body tapers towards the first end of the body and the second portion of the body tapers towards the second end of the body.

5. The molded tooth cleaning element according to claim 1 wherein a length of the tines of the first plurality of tines progressively decreases as the tines are positioned closer to the first end of the body and wherein a length of the tines of the second plurality of tines progressively decreases as the tines are positioned closer to the second end of the body.

6. The molded tooth cleaning element according to claim 1 wherein the body and the first and second pluralities of tines are integrally molded from thermoplastic polyurethane.

7. An oral care implement comprising:

a head; and a molded tooth cleaning element coupled to the head, the molded tooth cleaning element comprising:

a body extending from a first end to a second end along a longitudinal axis, the body comprising a first portion that includes the first end, a second portion that includes the second end, and a third portion located between the first and second portions;

a first plurality of tines extending from the body at an oblique angle along the first portion of the body, the first plurality of tines extending towards the first end of the body;

a second plurality of tines extending from the body at an oblique angle along the second portion of the body, the second plurality of tines extending towards the second end of the body; and wherein the body is alterable between: (1) an unfolded state in which the first and second portions of the body are spaced apart from one another; and (2) a folded state in which the first and second portions of the body are aligned with and in contact with one another.

8. A method of forming an oral care implement, the method comprising:

forming the oral care implement comprising a head and a handle, the head comprising a front surface having a plurality of holes;

injecting a material into a mold cavity to form a molded cleaning element in the mold cavity, the molded cleaning element comprising a body extending from a first end to a second end along a longitudinal axis, the body having a first portion, a second portion, and a third portion, the first portion comprising a first plurality of tines extending from the body at an oblique angle, the second portion comprising a second plurality of tines extending from the body at an oblique angle, the third portion of the body being located between the first and second portions of the body and being free of any tines extending therefrom, the body being in an unfolded state where the first and second portions of the body are spaced apart from one another;

removing the molded cleaning element from the mold cavity;

folding the molded cleaning element along the third portion of the body so that the body is altered into a folded state wherein the first and second portions of the body become aligned and in contact with one another;

inserting a portion of the molded cleaning element into one of the holes in the front surface of the head; and coupling the molded cleaning element to the head with a connection member so that the molded cleaning element extends from the front surface of the head.

9. The method according to claim 8 wherein the material is thermoplastic polyurethane.

10. The method according to claim 8 further comprising coupling a plurality of bristles to the head to form bristle tufts that extend from the front surface of the head.

11. The oral care implement according to claim 7 wherein in the unfolded state the first plurality of tines and the second plurality of tines extend from the body in opposite directions, and wherein in the folded state the first and second pluralities of tines extend from the body in the same direction.

12. The oral care implement according to claim 7 wherein the third portion of the body is devoid of any tines extending therefrom.

13. The oral care implement according to claim 7 wherein the first portion of the body tapers towards the first end of the body and the second portion of the body tapers towards the second end of the body.

14. The oral care implement according to claim 7 wherein a length of the tines of the first plurality of tines progressively decreases as the tines are positioned closer to the first end of the body and wherein a length of the tines of the second plurality of tines progressively decreases as the tines are positioned closer to the second end of the body.

15. The oral care implement according to claim 7 wherein the body and the first and second pluralities of tines are integrally molded from thermoplastic polyurethane.

* * * * *